US009514700B2

(12) United States Patent
Kitagawa et al.

(10) Patent No.: US 9,514,700 B2
(45) Date of Patent: Dec. 6, 2016

(54) SIGNAL PROCESSING DEVICE, LIQUID CRYSTAL APPARATUS, ELECTRONIC EQUIPMENT, AND SIGNAL PROCESSING METHOD

(71) Applicant: Seiko Epson Corporation, Tokyo (JP)

(72) Inventors: Taku Kitagawa, Shiojiri (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 381 days.

(21) Appl. No.: 13/801,864

(22) Filed: Mar. 13, 2013

(65) Prior Publication Data

US 2013/0257844 A1 Oct. 3, 2013

(30) Foreign Application Priority Data

Mar. 27, 2012 (JP) ..... 2012-071904

(51) Int. Cl.
*G09G 3/36* (2006.01)

(52) U.S. Cl.
CPC ..... *G09G 3/3696* (2013.01); *G09G 3/3648* (2013.01); *G09G 2320/0209* (2013.01); *G09G 2320/0219* (2013.01); *G09G 2340/16* (2013.01); *G09G 2360/16* (2013.01)

(58) Field of Classification Search
CPC G09G 3/3696; G09G 3/3648; G09G 2360/16; G09G 2340/16; G09G 2320/0219; G09G 3/36; G09G 2320/0209
USPC ..... 345/212, 87, 50, 698, 210
See application file for complete search history.

(56) References Cited

U.S. PATENT DOCUMENTS 5,852,430 A * 12/1998 Endo ..... G09G 3/3607 345/101
6,900,924 B2 * 5/2005 Goden ..... G09G 3/3446 345/107
2005/0237287 A1 * 10/2005 Kitamura ..... G09G 3/3614 345/87

(Continued)

FOREIGN PATENT DOCUMENTS

CN 1160863 A 10/1997
CN 101017637 A 8/2007

(Continued)

*Primary Examiner* — Thomas Alunkal
(74) *Attorney, Agent, or Firm* — ALG Intellectual Property, LLC

(57) ABSTRACT

A signal processing device of a liquid crystal apparatus detects a boundary between a first pixel to which a first voltage lower than a first reference voltage is applied and a second pixel to which a second voltage higher than a second reference voltage is applied on the basis of a signal for controlling a voltage applied to pixels, corrects a signal correlated with M pixels including the first pixel to a third voltage which is higher than the first voltage and lower than the second voltage, outputs the third voltage as an applied voltage to the M pixels in a first period, outputs the first voltage as an applied voltage to the M pixels in a second period, and outputs the third voltage as an applied voltage to the M pixels in a third period.

10 Claims, 18 Drawing Sheets

(56) References Cited

U.S. PATENT DOCUMENTS

| | | | | |
|---|---|---|---|---|
| 2007/0195028 | A1* | 8/2007 | Katayama | G09G 3/2011 345/87 |
| 2009/0102774 | A1* | 4/2009 | Hattori | G02F 1/133382 345/92 |
| 2009/0174799 | A1* | 7/2009 | Lee | H04N 5/3594 348/294 |
| 2009/0243983 | A1 | 10/2009 | Ohashi et al. | |
| 2010/0207934 | A1 | 8/2010 | Kato et al. | |
| 2011/0051006 | A1* | 3/2011 | Iisaka | G09G 3/3648 348/671 |
| 2011/0051007 | A1 | 3/2011 | Hosaka et al. | |
| 2011/0109815 | A1 | 5/2011 | Hosaka et al. | |
| 2011/0176071 | A1* | 7/2011 | Iisaka | G09G 3/3614 348/790 |
| 2011/0181795 | A1 | 7/2011 | Hosaka et al. | |
| 2011/0205207 | A1 | 8/2011 | Hosaka et al. | |
| 2011/0205208 | A1* | 8/2011 | Iisaka | G09G 3/3611 345/211 |
| 2011/0205439 | A1* | 8/2011 | Iisaka | G09G 3/2096 348/607 |
| 2011/0205440 | A1 | 8/2011 | Hosaka et al. | |
| 2011/0205452 | A1* | 8/2011 | Hosaka | G09G 3/3611 348/790 |
| 2011/0205479 | A1 | 8/2011 | Hosaka et al. | |
| 2012/0086684 | A1* | 4/2012 | Ichioka | G09G 3/2022 345/207 |
| 2012/0147272 | A1 | 6/2012 | Hosaka et al. | |

FOREIGN PATENT DOCUMENTS

| | | | |
|---|---|---|---|
| CN | 102005193 | A | 4/2011 |
| JP | 6-034965 | A | 2/1904 |
| JP | 2009-069608 | A | 4/2009 |
| JP | 2009-237366 | A | 10/2009 |
| JP | 2010-066442 | A | 3/2010 |
| JP | 2010-191157 | A | 9/2010 |
| JP | 2011-053390 | A | 3/2011 |
| JP | 2011-053417 | A | 3/2011 |
| JP | 2011-150223 | A | 5/2011 |
| JP | 2011-107174 | A | 6/2011 |
| JP | 2011-107497 | A | 6/2011 |
| JP | 2011-145501 | A | 7/2011 |
| JP | 2011-170235 | A | 9/2011 |
| JP | 2011-170236 | A | 9/2011 |
| JP | 2011-175136 | A | 9/2011 |
| JP | 2011-175137 | A | 9/2011 |
| JP | 2011-175199 | A | 9/2011 |
| JP | 2011-175200 | A | 9/2011 |
| JP | 2012-113226 | A | 6/2012 |
| JP | 2012-127991 | A | 7/2012 |
| JP | 2012-155212 | A | 8/2012 |
| JP | 2012-168229 | A | 9/2012 |
| JP | 2012-242797 | A | 12/2012 |
| JP | 2012-242798 | A | 12/2012 |
| WO | WO-2012-101990 | A | 8/2012 |

* cited by examiner

SCANNING LINE DRIVING CIRCUIT
FRAME
FIRST FIELD
SECOND FIELD
THIRD FIELD
FOURTH FIELD
H
VH
VL
Y1
Y2
Y3
Y4
Y(m−1)
Y(m)

VIDEO PROCESSING CIRCUIT
POSITIVE (POLARITY WRITING)
NEGATIVE (POLARITY WRITING)
VH
Vw(+)
Vb(+)
Vcnt
Vb(−)
Vw(−)
VL
Vx
Ha
H
FIRST ROW AND FIRST COLUMN
FIRST ROW AND SECOND COLUMN
FIRST ROW AND THIRD COLUMN
FIRST ROW AND n-TH COLUMN

FIG. 7

| | | APPLIED VOLTAGE [V] CORRESPONDING TO ORIGINAL GRAYSCALE | | | | | | | | | |
|---|---|---|---|---|---|---|---|---|---|---|---|
| | | 2.824 | 2.51 | 2.196 | 1.882 | 1.569 | 1.255 | 0.941 | 0.627 | 0.314 | 0 |
| APPLIED VOLTAGE [V] CORRESPONDING TO CORRECTED GRAYSCALE | 2.824 | 62.5 | 49.01 | 35.75 | 24.41 | 15.81 | 10.01 | 6.462 | 4.503 | 3.536 | 3.249 |
| | 2.51 | | 34.3 | 21.3 | 11.7 | 5.865 | 2.867 | 1.518 | 0.957 | 0.719 | 0.64 |
| | 2.196 | | | 10.7 | 4.348 | 1.613 | 0.67 | 0.35 | 0.23 | 0.18 | 0.164 |
| | 1.882 | | | | 1.37 | 0.46 | 0.207 | 0.119 | 0.084 | 0.067 | 0.06 |
| | 1.569 | | | | | 0.18 | 0.091 | 0.054 | 0.038 | 0.03 | 0.027 |
| | 1.255 | | | | | | 0.049 | 0.029 | 0.019 | 0.016 | 0.013 |
| | 0.941 | | | | | | | 0.018 | 0.011 | 0.007 | 0.006 |
| | 0.627 | | | | | | | | 0.006 | 0.004 | 0.002 |
| | 0.314 | | | | | | | | | 0.001 | 0.001 |
| | 0 | | | | | | | | | | 0 |

BOUNDARY DETECTION (PREVIOUS FRAME)

BOUNDARY DETECTION (CURRENT FRAME)

APPLIED BOUNDARY DETECTION

FIG. 9A RISK BOUNDARY DETECTION
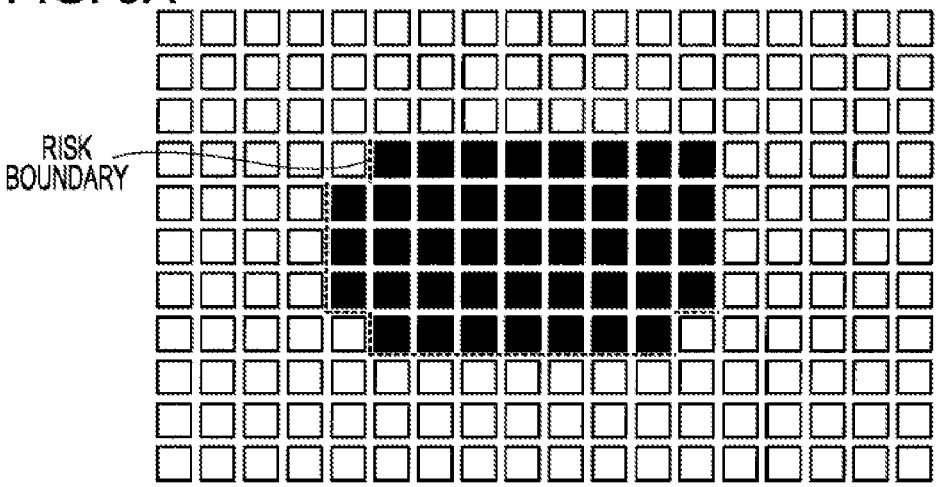
FIG. 9B CORRECTION TARGET BOUNDARY DETECTION ($\theta b = 45$ DEGREES)
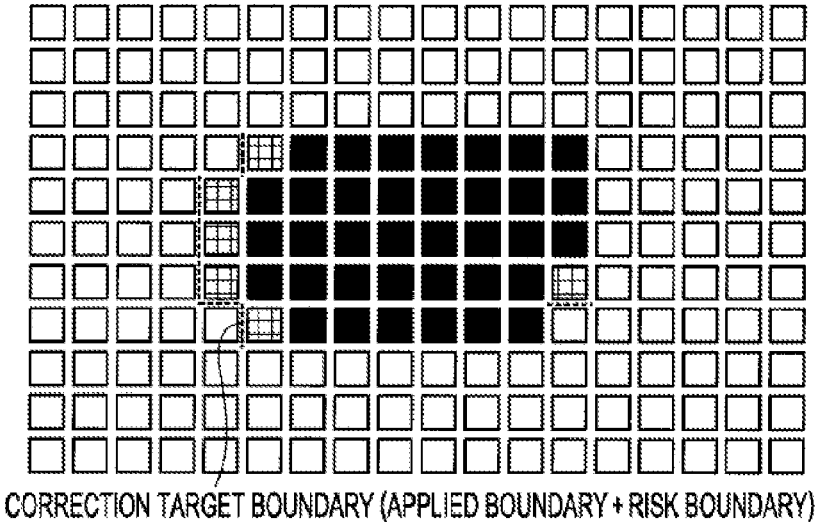
FIG. 10 CORRECTION PROCESS ($M = 3$, $\theta b = 45$ DEGREES)
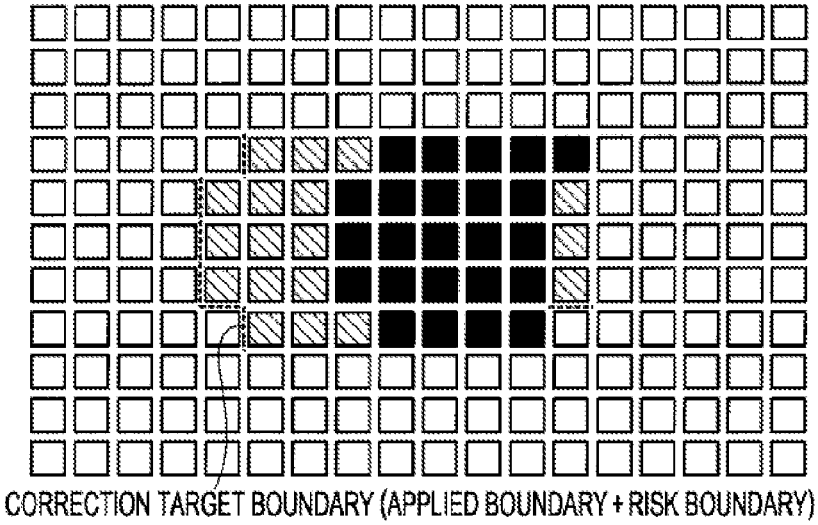

VIDEO SIGNAL Vid-in

VIDEO SIGNAL Vid-out
CORRECTION TARGET BOUNDARY
240 Hz
240 Hz
240 Hz
p1
p2
p3
ONE PIXEL MOVEMENT
ONE PIXEL MOVEMENT
60 Hz
60 Hz
TIME POINT VIDEO SIGNAL Vid-in
60 Hz
60 Hz
ONE PIXEL MOVEMENT
ONE PIXEL MOVEMENT
TIME POINT VIDEO SIGNAL Vid-out
CORRECTION TARGET BOUNDARY
240 Hz
240 Hz
240 Hz
p6
p5
p4

VIDEO SIGNAL Vid-in
60 Hz
60 Hz
ONE PIXEL MOVEMENT
ONE PIXEL MOVEMENT
TIME POINT

VIDEO SIGNAL Vid-out
CORRECTION TARGET BOUNDARY
240 Hz
240 Hz
240 Hz
p6 p5 p4 p1 p2 p3

VIDEO SIGNAL Vid-in
60 Hz
60 Hz
ONE PIXEL MOVEMENT
ONE PIXEL MOVEMENT
TIME POINT

VIDEO SIGNAL Vid-out
BOUNDARY
240 Hz
240 Hz
240 Hz

VIDEO SIGNAL Vid-in
60 Hz
60 Hz
ONE PIXEL MOVEMENT
ONE PIXEL MOVEMENT
TIME POINT

VIDEO SIGNAL Vid-out
PIXEL P
240 Hz
240 Hz
240 Hz

IN CASE OF EMPLOYING INTERMEDIATE GRAYSCALE

AVAILABLE REGION

| APPLIED VOLTAGE [V] CORRESPONDING TO CORRECTED GRAYSCALE | APPLIED VOLTAGE [V] CORRESPONDING TO ORIGINAL GRAYSCALE | | | | | | | | | |
|---|---|---|---|---|---|---|---|---|---|---|
| | 2.824 | 2.51 | 2.196 | 1.882 | 1.569 | 1.255 | 0.941 | 0.627 | 0.314 | 0 |
| 2.824 | 62.5 | 49.01 | 35.75 | 24.41 | 15.81 | 10.01 | 6.462 | 4.503 | 3.536 | 3.249 |
| 2.51 | | 34.3 | 21.3 | 11.7 | 5.865 | 2.867 | 1.518 | 0.957 | 0.719 | 0.64 |
| 2.196 | | | 10.7 | 4.348 | 1.613 | 0.67 | 0.35 | 0.23 | 0.18 | 0.16 |
| 1.882 | | | | 1.37 | 0.46 | 0.207 | 0.119 | 0.084 | 0.067 | 0.06 |
| 1.569 | | | | | 0.18 | 0.091 | 0.054 | 0.038 | 0.03 | 0.027 |
| 1.255 | | | | | | 0.049 | 0.029 | 0.019 | 0.016 | 0.013 |
| 0.941 | | | | | | | 0.018 | 0.011 | 0.007 | 0.006 |
| 0.627 | | | | | | | | 0.006 | 0.004 | 0.002 |
| 0.314 | | | | | | | | | 0.001 | 0.001 |
| 0 | | | | | | | | | | 0 |

SIGNAL PROCESSING DEVICE, LIQUID CRYSTAL APPARATUS, ELECTRONIC EQUIPMENT, AND SIGNAL PROCESSING METHOD

BACKGROUND

1. Technical Field

The present invention relates to a technique capable of reducing display defects in a liquid crystal panel.

2. Related Art

A liquid crystal panel has a configuration in which liquid crystal is interposed between a pixel electrode provided for each pixel and a common electrode provided so as to be common to a plurality of pixels. In this liquid crystal panel, there are cases where poor liquid crystal alignment (reverse tilt domain) occurs due to a transverse electric field generated between pixels adjacent to each other, thereby causing display defects. Techniques for suppressing display defects due to poor liquid crystal alignment from occurring are disclosed in JP-A-2009-237366 and JP-A-2010-191157. JP-A-2009-237366 and JP-A-2010-191157 disclose a technique for reducing a transverse electric field occurring in a pixel in which poor image quality tends to occur due to a deposition direction of a liquid crystal alignment (inorganic alignment layer) among pixels to which a strong transverse electric field is applied.

However, the larger the value obtained by temporally integrating a rate of change of transmittance of a liquid crystal element due to an application of a correction voltage with respect to the time, the more likely to be perceived by a user the variation of display content caused by a correction target pixel. In the technique disclosed in JP-A-2009-237366 and JP-A-2010-191157, it is considered that, since, in a correction target pixel, a constant correction voltage is applied to the liquid crystal element during the entire display period corresponding to each video signal, a transmittance variation due to correction of an applied voltage to the liquid crystal element increases, and thus display content different from display content regulated by an original video signal is likely to be perceived by a user.

SUMMARY

An advantage of some aspects of the invention is to correct a video signal corresponding to each display period so as to suppress a transmittance variation of a liquid crystal element for each display period due to application of a correction voltage and to reduce a reverse tilt domain.

According to an aspect of the invention, there is provided a signal processing device which is used in a liquid crystal apparatus including a plurality of pixels, the device including a detection portion that detects a boundary between a first pixel correlated with a first signal for applying a first voltage lower than a first reference voltage and a second pixel correlated with a second signal for applying a second voltage higher than a second reference voltage on the basis of a signal for controlling a voltage applied to each of the plurality of pixels; a correction portion that corrects a signal correlated with M (where M is an integer equal to or more than 1) pixels including the first pixel to a third signal for applying a third voltage which is higher than the first voltage and lower than the second voltage; and an output portion that outputs the signals, wherein the output portion outputs the third signal as the signal correlated with the M pixels including the first pixel in a first period; outputs the first signal as the signal correlated with the M pixels including the first pixel in a second period; and outputs the third signal as the signal correlated with the M pixels including the first pixel in a third period.

According to the aspect of the invention, since a transverse electric field which is a cause of generation of a reverse tilt domain is generated in a different manner depending on an applied voltage to the first pixel, a correction voltage corresponding to an applied voltage to the first pixel is applied to at least some of each display period, and thereby it is possible to suppress a transmittance variation of a liquid crystal element for each display period and to reduce a reverse tilt domain.

In the aspect of the invention, the correction portion may correct a signal correlated with N (where N is an integer equal to or more than 1) pixels including the second pixel to a fourth signal for applying a fourth voltage which is higher than the first voltage and lower than the second voltage, and wherein the output portion outputs the fourth signal as the signal correlated with the N pixels including the second pixel in the first period; outputs the second signal as the signal correlated with the N pixels including the second pixel in the second period; and outputs the fourth signal as the signal correlated with the N pixels including the second pixel in the third period.

According to the aspect of the invention, since each of adjacent first pixel and second pixel can be corrected so as to reduce the strength of a transverse electric field, it is possible to suppress a variation in video signals due to correction of the first and second pixels and to increase an effect of reducing a reverse tilt domain.

According to another aspect of the invention, there is provided a signal processing device which is used in a liquid crystal apparatus including a plurality of pixels, the device including a detection portion that detects a boundary between a first pixel correlated with a first signal for applying a first voltage lower than a first reference voltage and a second pixel correlated with a second signal for applying a second voltage higher than a second reference voltage on the basis of a signal for controlling a voltage applied to each of the plurality of pixels; a correction portion that corrects a signal correlated with N (where N is an integer equal to or more than 1) pixels including the second pixel to a fourth signal for applying a fourth voltage which is higher than the first voltage and lower than the second voltage; and an output portion that outputs the signals, wherein the output portion outputs the fourth signal as the signal correlated with the N pixels including the second pixel in a first period; outputs the second signal as the signal correlated with the N pixels including the second pixel in a second period; and outputs the fourth signal as the signal correlated with the N pixels including the second pixel in a third period.

According to another aspect of the invention, since a transverse electric field which is a cause of generation of a reverse tilt domain is generated in a different manner depending on an applied voltage to the second pixel, a correction voltage corresponding to an applied voltage to the second pixel is applied at least some of each display period, and thereby it is possible to suppress a transmittance variation of a liquid crystal element for each display period and to reduce a reverse tilt domain.

In another aspect of the invention, the correction portion may decrease the correction voltage of the first pixel as the applied voltage to the first pixel becomes higher.

According to another aspect of the invention, since a correction voltage increases in order to increase an effect of reducing a reverse tilt domain with respect to the first pixel in which a transverse electric field is likely to be strengthened, and a correction voltage decreases in order to suppress a variation of display content with respect to the first pixel in which a transverse electric field is unlikely to be strengthened, it is possible to realize suppression of a transmittance variation of the liquid crystal element and reduction in a reverse tilt domain in a well-balanced manner.

In another aspect of the invention, the correction portion may correct video signals of M (where M is equal to or more than 2) pixels which are continuously located from the first pixel adjacent to a boundary detected by the detection portion in an opposite direction to the boundary, to video signals which designates the correction voltage corresponding to the first pixel of any one of the M first pixels.

According to another aspect of the invention, in a case where a plurality of first pixels are set as correction targets, a correction voltage is set based on any one of the first pixels, and thus it is possible to reduce a calculation amount as compared with a case where a correction voltage is set for each of the first pixels.

In another aspect of the invention, the correction portion may correct the video signal corresponding to the first pixel such that an integral transmittance obtained by temporally integrating a transmittance of the liquid crystal element when the correction voltage is applied over the display period is equal to or less than a first threshold value regardless of the applied voltage to the first pixel.

According to another aspect of the invention, an integral transmittance obtained by temporally integrating a transmittance of the liquid crystal element over the display period is equal to or less than the first threshold value, and thereby it is possible to perform correction for reducing a reverse tilt domain in a range in which a variation in display content which is likely to be perceived by a user does not occur.

In another aspect of the invention, the correction portion may increase the correction voltage of the second pixel as the applied voltage to the second pixel becomes lower.

According to another aspect of the invention, since a correction voltage decreases in order to increase an effect of reducing a reverse tilt domain with respect to the second pixel in which a transverse electric field is likely to be strengthened, and a correction voltage increases in order to suppress a variation of display content with respect to the second pixel in which a transverse electric field is unlikely to be strengthened, it is possible to realize suppression of a transmittance variation of the liquid crystal element and reduction in a reverse tilt domain in a well-balanced manner.

In another aspect of the invention, the correction portion may correct video signals of N (where N is equal to or more than 2) pixels which are continuously located from the second pixel adjacent to a boundary detected by the detection portion in an opposite direction to the boundary, to video signals which designates the correction voltage corresponding to the second pixel of any one of the N second pixels.

According to another aspect of the invention, in a case where a plurality of second pixels are set as correction targets, a correction voltage is set based on any one of the second pixels, and thus it is possible to reduce a calculation amount as compared with a case where a correction voltage is set for each of the second pixels.

In another aspect of the invention, the correction portion may correct the video signal corresponding to the second pixel such that an integral transmittance obtained by temporally integrating a transmittance of the liquid crystal element when the correction voltage is applied over the display period is equal to or more than a second threshold value regardless of the applied voltage to the second pixel.

According to another aspect of the invention, an integral transmittance obtained by temporally integrating a transmittance of the liquid crystal element over the display period is equal to or more than the second threshold value, and thereby it is possible to perform correction for reducing a reverse tilt domain in a range in which a variation in display content which is likely to be perceived by a user does not occur.

In another aspect of the invention, the correction portion may acquire information indicating temperature of the liquid crystal element and make the correction voltage different depending on temperature indicated by the acquired information.

According to another aspect of the invention, it is possible to set a correction voltage for suppressing a variation in display content and reducing a reverse tilt domain on the basis of characteristics of liquid crystal molecules of which the viscosity varies depending on temperature.

In addition, the invention is not limited to the signal processing device and is applicable to a signal processing method and electronic equipment including a liquid crystal display apparatus.

BRIEF DESCRIPTION OF THE DRAWINGS

The invention will be described with reference to the accompanying drawings, wherein like numbers reference like elements.

FIG. 7 is a diagram illustrating a relationship between an applied voltage corresponding to an original grayscale and a correction voltage corresponding to a correction grayscale.

FIGS. 9A and 9B are diagrams illustrating boundary detection procedures in the same video processing circuit.

FIG. 10 is a diagram illustrating a correction target boundary and a correction target pixel in the same video processing circuit.

DESCRIPTION OF EXEMPLARY EMBODIMENTS

Hereinafter, embodiments of the invention will be described with reference to the drawings.

First Embodiment

First, a description will be made of the first embodiment of the invention.

Figure 1:
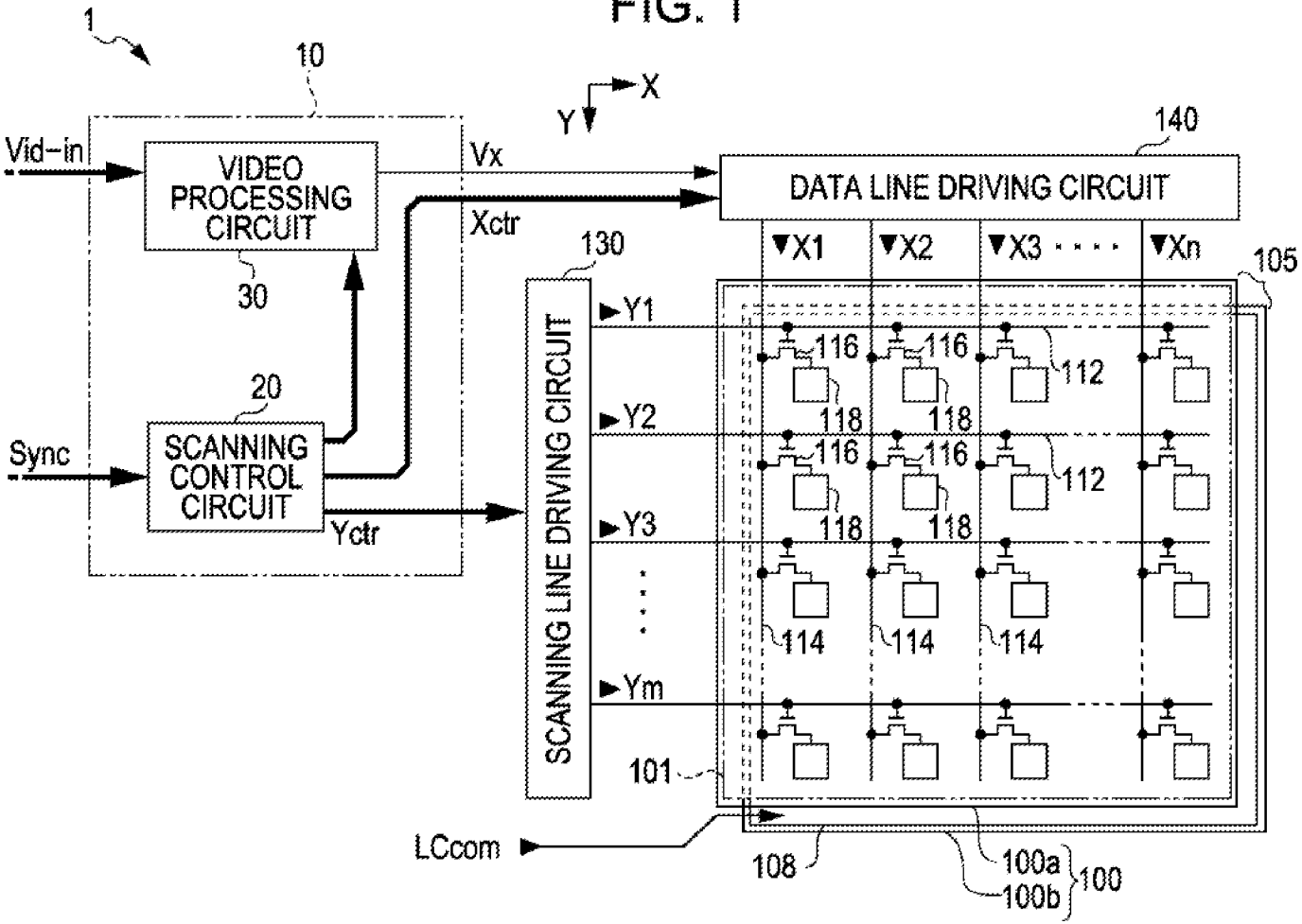
FIG. 1 is a diagram illustrating a liquid crystal display apparatus which employs a video processing circuit (signal processing device) according to a first embodiment of the invention.

FIG. 1 is a block diagram illustrating an entire configuration of a liquid crystal display apparatus 1 which employs a video processing circuit according to the present embodiment.

As shown in FIG. 1, the liquid crystal display apparatus 1 includes a control circuit 10, a liquid crystal panel 100, a scanning line driving circuit 130, and a data line driving circuit 140. A video signal Vid-in is supplied to the control circuit 10 from a high rank device in synchronization with synchronization signals Sync. The video signal Vid-in is digital data which designates a grayscale level of each pixel of the liquid crystal panel 100, and is supplied in order of scanning according to a vertical scanning signal, a horizontal scanning signal, and a dot clock signal (none shown) included in the synchronization signals Sync. In the present embodiment, a frequency at which the video signals Vid-in are supplied is 60 Hz, and the video signals Vid-in for displaying an image of one frame (one scene) are supplied at a cycle 16.67 milliseconds which is a reciprocal of 60 Hz.

In addition, the video signal Vid-in designates a grayscale level, but an applied voltage to a liquid crystal element is defined according to the grayscale level, and thus the video signal Vid-in may designate an applied voltage to the liquid crystal element. In the following description, it is assumed that the higher the grayscale level of a video signal, the larger the applied voltage designated for a liquid crystal element.

The control circuit 10 includes a scanning control circuit 20 and a video processing circuit 30. The scanning control circuit 20 generates various control signals and controls the respective parts in synchronization with the synchronization signals Sync. The video processing circuit 30 will be described later in detail, and processes a digital video signal Vid-in and outputs an analog data signal Vx.

The liquid crystal panel 100 has a configuration in which an element substrate (first substrate) 100*a* and an opposite substrate (second substrate) 100*b* are joined to each other with a specific gap, and liquid crystal 105 which is driven by an electric field in the longitudinal direction is interposed in the gap. The element substrate 100*a* is provided with a plurality of scanning lines 112 of m rows in the X (transverse) direction, and a plurality of data lines 114 of n columns in the Y (longitudinal) direction so as to be electrically insulated from the respective scanning lines 112 in an opposite surface to the opposite substrate 100*b*.

In addition, in this embodiment, in order to differentiate the scanning lines 112 from each other, the scanning lines are referred to as scanning lines of first, second, third, . . . , (m−1)-th, and m-th rows in order from the top in some cases. Similarly, in order to differentiate the data lines 114 from each other, the data lines are referred to as data lines of first, second, third, . . . , (n−1)-th, and n-th columns in order from the left in some cases.

In the element substrate 100*a*, a set of an n cannel type TFT 116 and a rectangular transparent pixel electrode 118 is provided so as to correspond to each of intersections of the scanning lines 112 and the data lines 114. A gate electrode of the TFT 116 is connected to the scanning line 112, a source electrode thereof is connected to the data line 114, and a drain electrode thereof is connected to the pixel electrode 118. On the other hand, the opposite substrate 100*b* is provided with a transparent common electrode 108 on an entire surface in an opposite surface to the element substrate 100*a*. A voltage LCcom is applied to the common electrode 108 by a circuit (not shown).

In addition, in FIG. 1, since the opposite surface of the element substrate 100*a* is a back side of the figure, the scanning lines 112, the data lines 114, the TFTs 116, and the pixel electrodes 118 provided on the opposite surface are indicated by broken lines but are difficult to observe, and are thus indicated by the solid lines, respectively.

Figure 2:
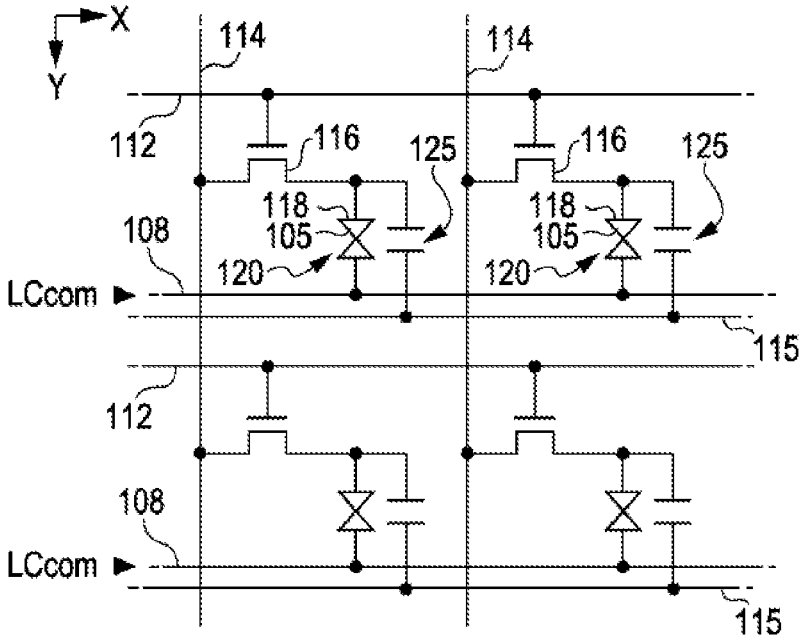
FIG. 2 is a diagram illustrating an equivalent circuit of a liquid crystal element in the same liquid crystal display apparatus.

FIG. 2 is a diagram illustrating an equivalent circuit of the liquid crystal panel 100.

As shown in FIG. 2, the liquid crystal panel 100 has a configuration in which liquid crystal elements 120 where the liquid crystal 105 is interposed between the pixel electrode 118 and the common electrode 108 are arranged so as to correspond to the intersections of the scanning lines 112 and the data lines 114. Although not shown in FIG. 1, in the equivalent circuit of the liquid crystal panel 100, as shown in FIG. 2, auxiliary capacitors (storage capacitors) 125 are practically provided in parallel to the liquid crystal elements 120. One end of each of the auxiliary capacitors 125 is connected to the pixel electrode 118 and the other end thereof is connected in common to a capacitance line 115. The capacitance line 115 is maintained at a voltage which is constant temporally.

Here, when the scanning line 112 is turned to an H level, the TFT 116 of which the gate electrode is connected to the scanning line is turned on, and thus the pixel electrode 118 is connected to the data line 114. Therefore, when the scanning line 112 is in an H level, a data signal with a voltage corresponding to a grayscale is supplied to the data line 114, and thus the data signal is applied to the pixel electrode 118 via the turned-on TFT 116. When the scanning line 112 is turned to an L level, the TFT 116 is turned off, but the voltage applied to the pixel electrode 118 is maintained by the capacitive characteristics of the liquid crystal element 120 and the auxiliary capacitor 125.

A molecular alignment state of the liquid crystal 105 varies depending on an electric field generated by the pixel electrode 118 and the common electrode 108 in the liquid crystal element 120. For this reason, if the liquid crystal element 120 is of a transmissive type, a transmittance corresponding to an applied and maintained voltage is shown. In the liquid crystal panel 100, a transmittance varies for each liquid crystal element 120, and thus the liquid crystal element 120 corresponds to a pixel. In addition, a region where the pixels are arranged is a display region 101.

Further, in the present embodiment, the liquid crystal 105 is of a VA type, and the liquid crystal element 120 is set in a normally black mode in which a black state happens when a voltage is not applied.

Figure 5A:
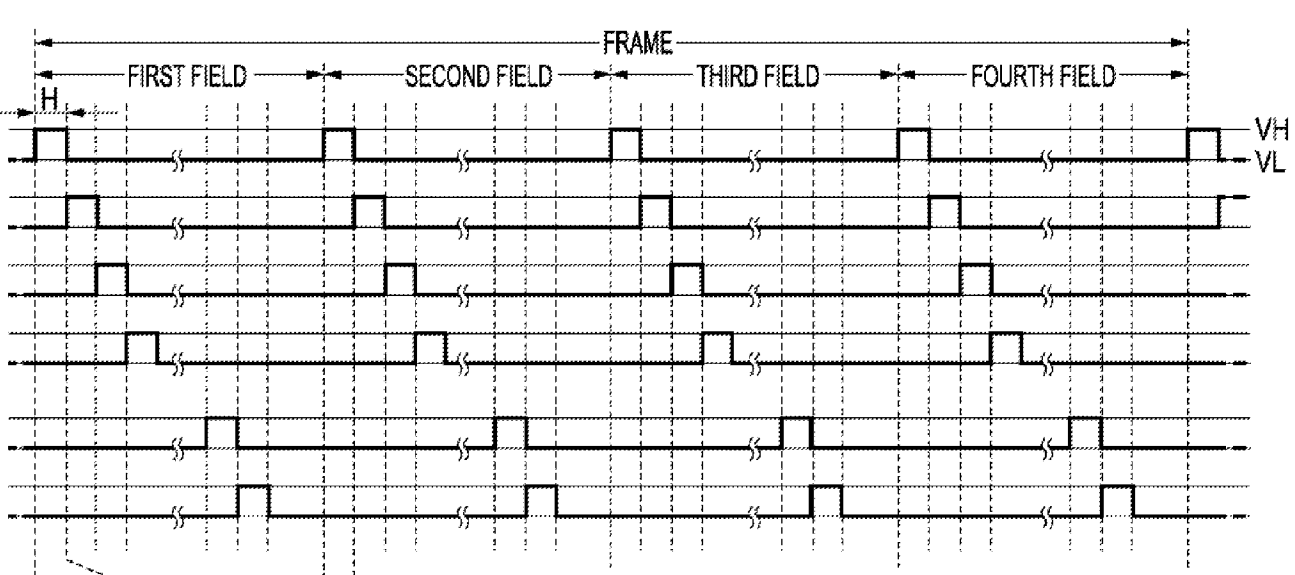
FIGS. 5A and 5B are diagrams illustrating a display operation in the same liquid crystal panel.

Referring to FIG. 1 again, the scanning line driving circuit 130 supplies scanning signals Y1, Y2, Y3, . . . , and Ym to the scanning lines 112 of the first, second, third, . . . , and m-th rows in response to a control signal Yctr from the scanning control circuit 20. Specifically, as shown in FIG. 5A, the scanning line driving circuit 130 selects the scanning lines 112 in order of the first, second, third, . . . , (m−1)-th, and m-th rows during a frame, sets a scanning signal to the selected scanning line to a selection voltage VH (H level), and sets scanning signals to the other scanning lines to a non-selection voltage VL (L level).

Figure 5B:
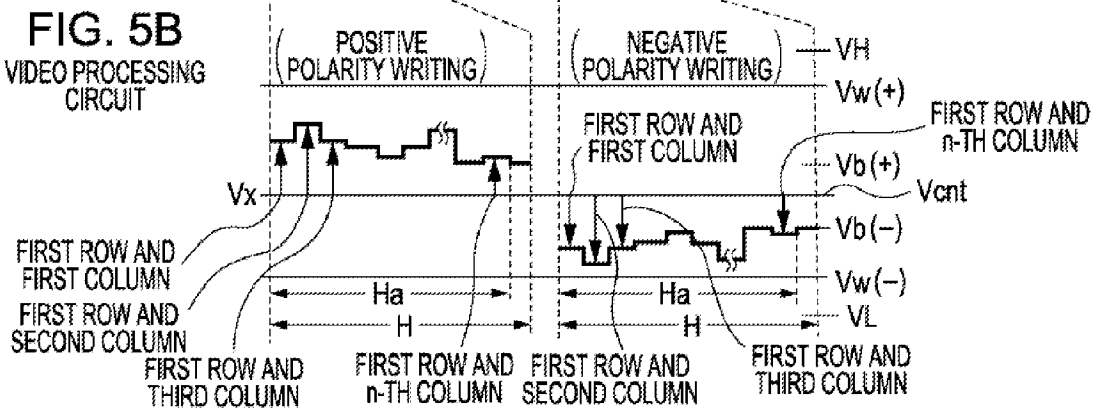

In addition, the frame refers to a period required to display one scene of an image on the liquid crystal panel 100 by driving the liquid crystal panel 100. In the present embodiment, the frequency of the vertical scanning signal controlled by the synchronization signal Sync is 240 Hz. As shown in FIG. 5A, in the liquid crystal display apparatus 1, one frame is divided into four fields including first to fourth fields, and the scanning lines of the first to m-th rows are scanned, thereby realizing so-called quadruple speed driving. In other words, the liquid crystal display apparatus 1 drives the liquid crystal panel 100 at a driving speed of 240 Hz based on the video signal Vid-in which is supplied at a supply speed of 60 Hz from the high rank device and thus displays an image of one frame based on the video signal Vid-in. A period of one field corresponds to a ¼ frame period and is about 4.16 milliseconds here. In addition, as shown in FIG. 5B, in the liquid crystal display apparatus 1, positive writing is designated in the first and third fields and negative writing is designated in the second and fourth fields such that a writing polarity is reversed for each field, thereby writing data in the pixels.

The data line driving circuit 140 samples a data signal Vx supplied from the video processing circuit 30 in the data lines 114 of the first to n-th columns in response to the control signal Xctr from the scanning control circuit 20 as data signals X1 to Xn.

In addition, in this description, in relation to a voltage, a ground potential is used as voltage zero unless particularly mentioned except for an applied voltage to the liquid crystal element 120. The applied voltage to the liquid crystal element 120 is a potential difference between the voltage LCcom of the common electrode 108 and a voltage of the pixel electrode 118 and is used to be differentiated from other voltages.

Figure 4A:
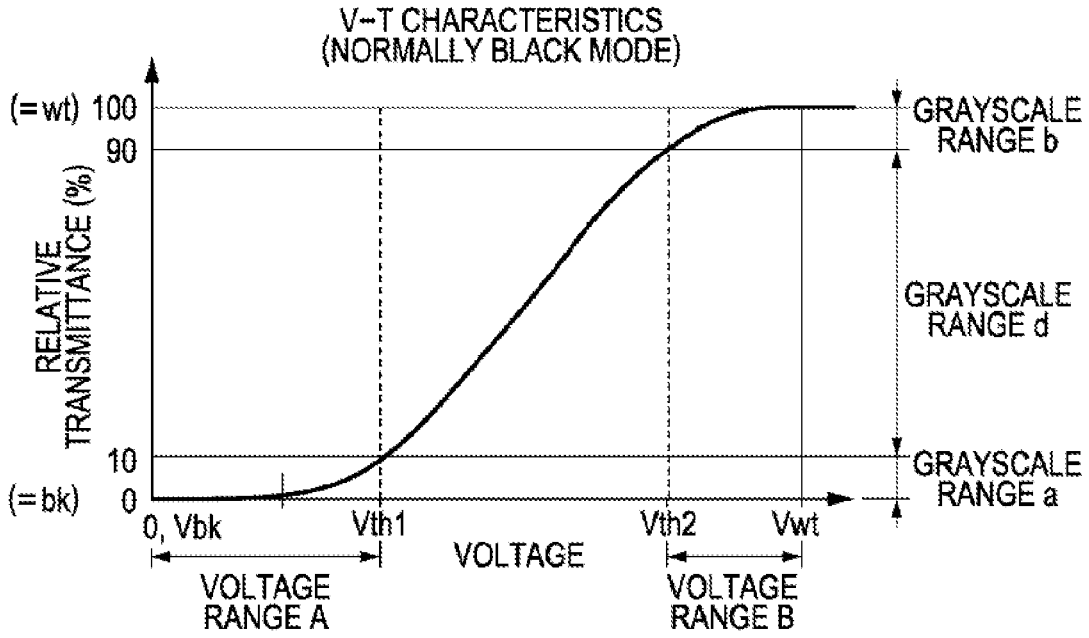
FIGS. 4A and 4B are diagrams illustrating V-T characteristics of a liquid crystal panel forming the same liquid crystal display apparatus.
Figure 4B:
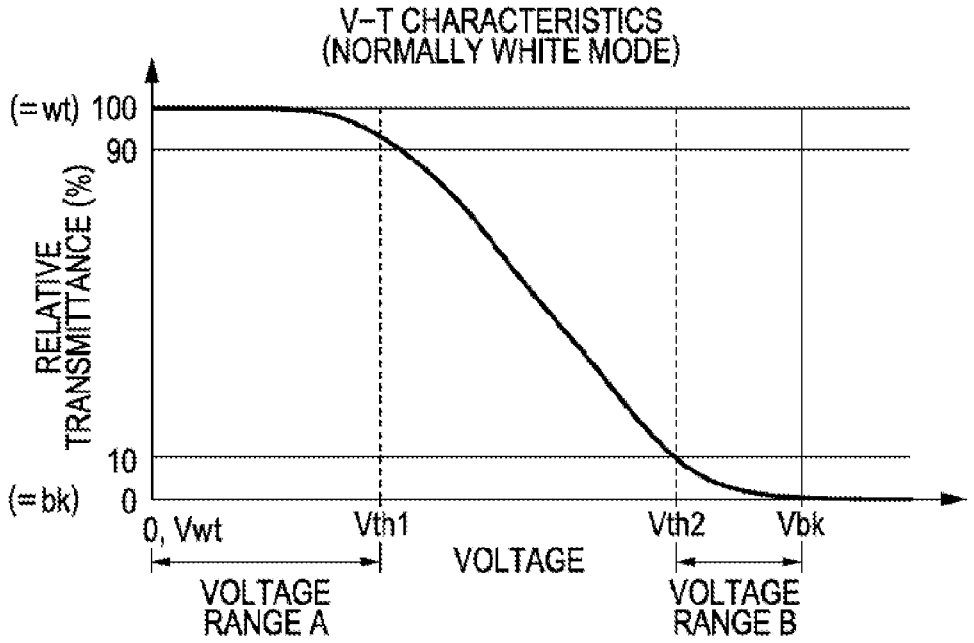

Meanwhile, a relationship between an applied voltage to the liquid crystal element 120 and the transmittance is expressed by the V-T characteristics, for example, as shown in FIG. 4A, in the normally black mode. For this reason, in order to make the liquid crystal element 120 represent a transmittance corresponding to a grayscale level designated by the video signal Vid-in, a voltage corresponding to the grayscale level may be applied to the liquid crystal element 120. However, if an applied voltage to the liquid crystal element 120 is merely regulated according to a grayscale level designated by the video signal Vid-in, there are cases where display defects occur due to a reverse tilt domain.

Figure 21:
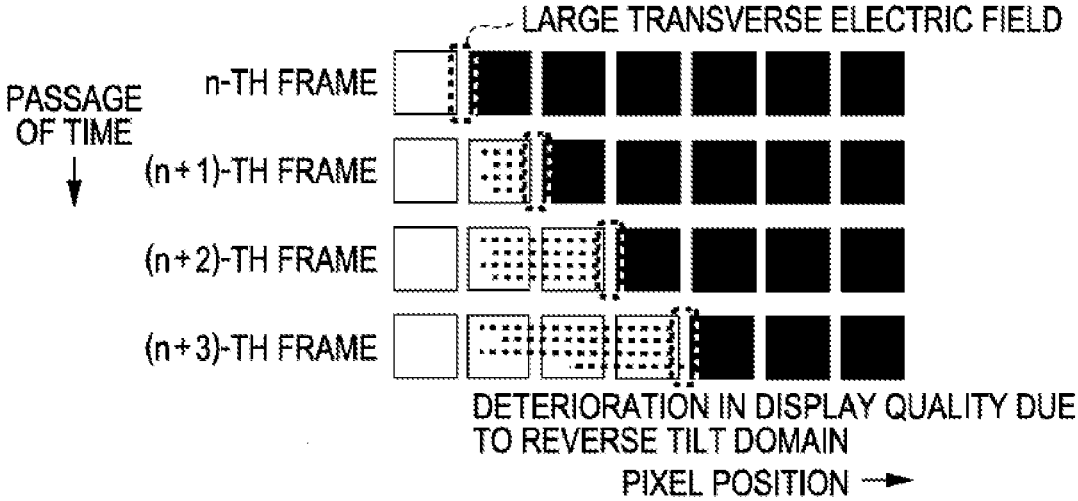
FIG. 21 is a diagram illustrating display defects and the like due to influence of a transverse electric field.

An example of the display defects due to the reverse tilt domain will be described. For example, as shown in FIG. 21, in a case where a black pattern in which black pixels are continuously located is moved to the right by one pixel for each frame as a background of white pixels in an image represented by the video signal Vid-in, a pixel which is to be varied from the black pixel to the white pixel at the left end edge (rear edge part of the movement) of the black pattern becomes apparent in some sort of tailing phenomenon in which the pixel is not varied to a white pixel due to occurrence of a reverse tilt domain. On the other hand, in the liquid crystal panel 100, when a region of the black pixels where white pixels are a background moves by two pixels for each frame, this tailing phenomenon does not become apparent (or is unlikely to be visually recognized) if a response time of the liquid crystal element is shorter than a time interval (that is, one frame period) when a display image is updated. This reason may be considered as follows. In other words, this is because it is considered that, when a white pixel and a black pixel are adjacent to each other in a certain frame, a reverse tilt domain may occur in the white pixel, but, if a movement of an image is considered, pixels in which the reverse tilt domain occurs are discrete, and thus the tailing phenomenon is not visible.

One of the causes of the display defects due to the reverse tilt domain may be that the liquid crystal molecules interposed in the liquid crystal element 120 are disarrayed due to influence of a transverse electric field when the liquid crystal molecules are in an unstable state, and, then, an alignment state corresponding to an applied voltage is unlikely to happen.

Here, the case of being influenced by the transverse electric field is a case where a potential difference between pixels adjacent to each other increases, and this is a case where a dark pixel in a black level (or close to a black level) and a bright pixel in a white level (or close to a white level) are adjacent to each other in an image to be displayed. Therefore, in the present embodiment, the dark pixel refers to a pixel of the liquid crystal element 120 to which an applied voltage is in a voltage range A (first voltage) equal to or more than a voltage Vbk of the black level in the normally black mode and lower than a threshold value Vth1 (first threshold voltage). In addition, for convenience, a transmittance range (grayscale range) of a liquid crystal element in which an applied voltage to the liquid crystal element is in the voltage range A is indicated by "a".

Next, the bright pixel refers to a pixel of the liquid crystal element 120 to which an applied voltage is in a voltage range B (second voltage) equal to or more than a threshold value Vth2 (second threshold voltage) and equal to or less than a white level voltage Vwt in the normally black mode. In addition, for convenience, a transmittance range (grayscale range) of a liquid crystal element in which an applied voltage to the liquid crystal element is in the voltage range B is indicated by "b".

In addition, in the normally black mode, the threshold value Vth1 is an optical threshold voltage which sets a relative transmittance of the liquid crystal element to 10%, and the threshold value Vth2 is an optical saturation voltage which sets the relative transmittance of the liquid crystal element to 90%. However, the threshold value Vth1 and the threshold value Vth2 may be voltages which respectively correspond to different relative transmittances under the condition of Vth2>Vth1.

In this concept, it can be said that a pixel lies in circumstances in which a reverse tilt domain is likely to occur due to influence of a transverse electric field when a dark pixel and a bright pixel become adjacent to each other through movement of an image. However, if an examination is performed in consideration of an initial alignment state of the liquid crystal molecules, a reverse tilt domain may occur or may not occur depending on a positional relationship between a dark pixel and a bright pixel.

Figure 6A:
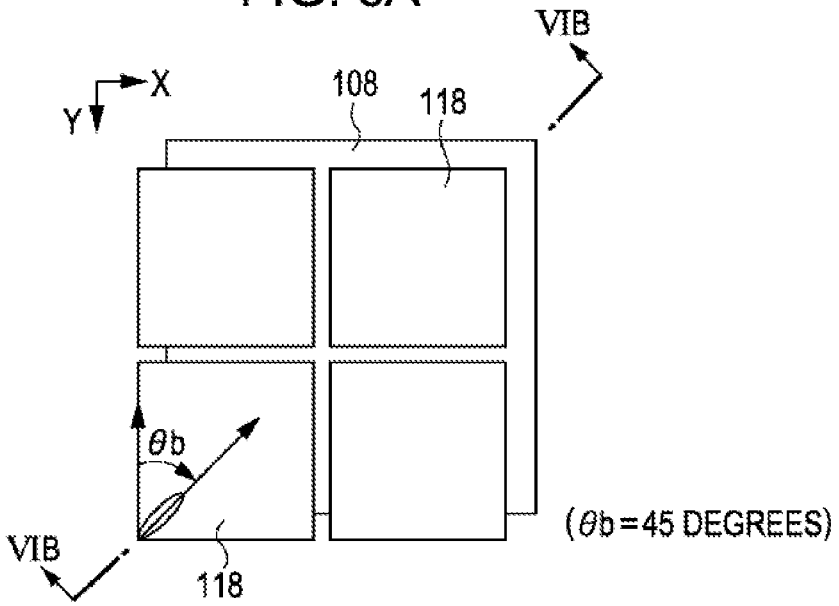
FIGS. 6A to 6C are diagrams illustrating an initial alignment when the same liquid crystal panel is of a VA type.
Figure 6B:
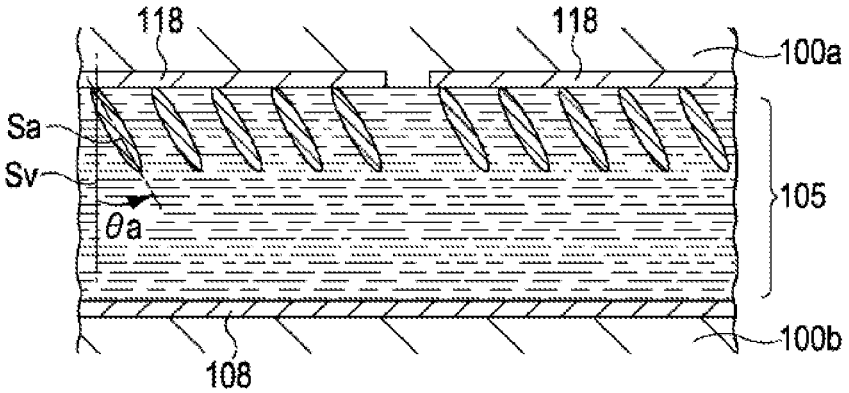

FIG. 6A is a diagram illustrating 2×2 pixels which are adjacent to each other in the longitudinal direction and transverse direction in the liquid crystal panel 100, and FIG. 6B is a simple cross-sectional view taken along the line VIB-VIB in the liquid crystal panel 100 of FIG. 6A.

Figure 6C:
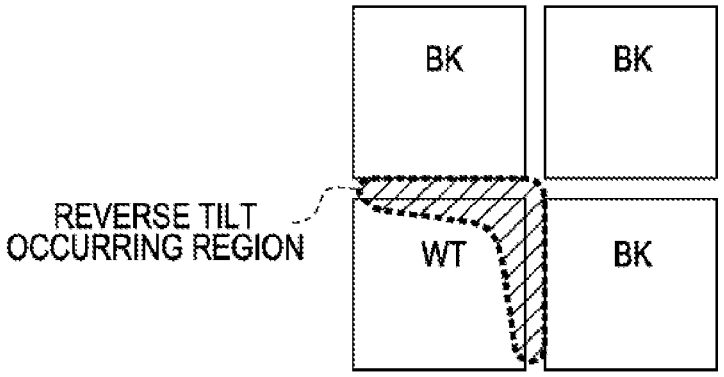

As shown in FIGS. 6A to 6C, the VA type liquid crystal molecules are initially aligned at a tilt angle θa and a tilt azimuth θb (=45 degrees) in a state in which a potential difference (an applied voltage to the liquid crystal element) between the pixel electrode 118 and the common electrode 108 is zero. Here, since a reverse tilt domain is caused by a transverse electric field between the pixel electrodes 118 as described above, behaviors of the liquid crystal molecules on the element substrate 100*a* side in which the pixel electrodes 118 are provided are problematic. For this reason, the tilt azimuth and the tilt angle of the liquid crystal molecules are regulated using the pixel electrode 118 (the element substrate 100*a*) side as a reference.

Specifically, the tilt angle θa is an angle formed by the major axis Sa of the liquid crystal molecule with respect to the substrate normal line Sv when one end on the pixel electrode 118 side is fixed and the other end on the common electrode 108 side is tilted in the major axis Sa of the liquid crystal molecule as shown in FIG. 6B.

Meanwhile, the tilt azimuth θb is an angle formed by a substrate vertical plane (a vertical plane including the line VIB-VIB) including the major axis Sa of the liquid crystal molecule and the substrate normal line Sv with respect to a substrate vertical plane in the Y direction which is an arrangement direction of the data lines 114. In addition, in relation to the tilt azimuth θb, in plan view from the pixel electrode 118 side to the common electrode 108, an angle in a direction (an upper right direction in FIG. 6A) toward the other end starting from one end of the major axis of the liquid crystal molecule from a screen upward direction (an opposite direction to the Y direction) is regulated as a clockwise direction.

In addition, similarly, in plan view from the pixel electrode 118 side, for convenience, a direction from one end on the pixel electrode side to the other end in the liquid crystal molecule is referred to as a downstream side of the tilt azimuth, and, for convenience, an opposite direction (a lower left direction in FIG. 6A) from the other end to one end is referred to as an upstream side of the tilt azimuth.

In a case where a tilt azimuth θb is 45 degrees as shown in FIG. 6A in the VA type (normally black mode) liquid crystal, when only a self pixel varies to a bright pixel in a state in which the liquid crystal molecules are unstable in the self pixel and peripheral pixels, reverse tilt in the self pixel occurs in an inner circumferential region along the left side and the upper side as shown in FIG. 6C. Therefore, in a case where a dark pixel is adjacent to a bright pixel, and the dark pixel is located on the upper right side, the right side or the upper side of the bright pixel in an image represented by the video signal Vid-in, when a correction voltage is applied to a liquid crystal element corresponding to the dark pixel, a poor alignment state of the liquid crystal molecules is unlikely to happen, and thus a reverse tilt domain is unlikely to occur.

Figures 22A, 22B:
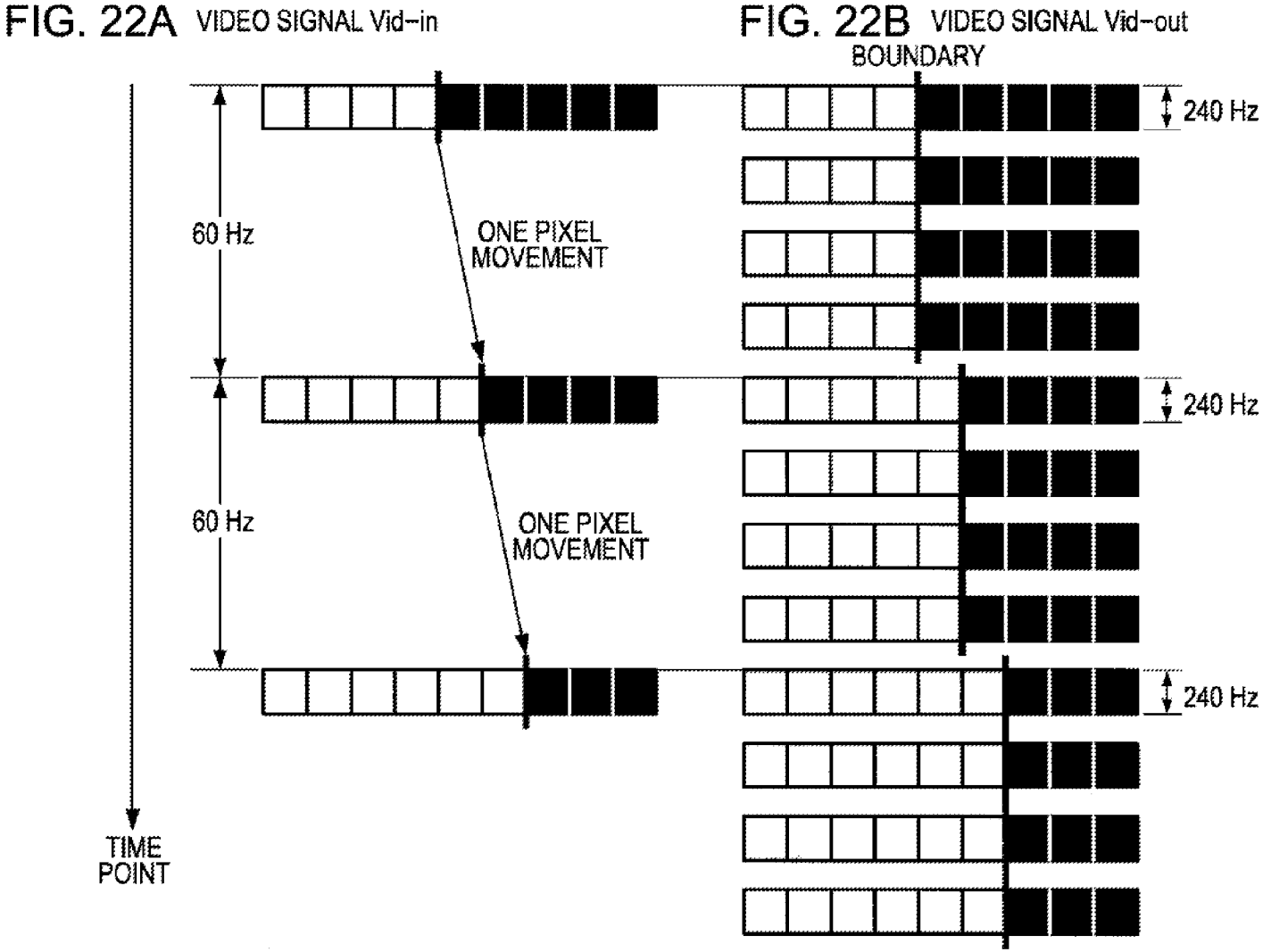
FIGS. 22A and 22B are diagrams illustrating a relationship between input and output video signals at normal quadruple speed driving.

Here, a description will be made of a relationship between a video signal Vid-in (FIG. 22A) and a video signal Vid-out (FIG. 22B) in normal quadruple speed driving. FIGS. 22A and 22B show pixels of an image of one line, and each rectangle corresponds to one pixel. Here, the pixel shown black is a dark pixel, and the pixel shown white is a bright pixel.

In FIG. 22B, in the video signal Vid-out corresponding to the video signal Vid-in, video signals Vid-out respectively corresponding to the first, second, third and fourth fields are shown in order from the top of FIG. 22B.

As shown in FIG. 22A, it is assumed that video signals Vid-in are supplied at a supply speed of 60 Hz, and, the video signals Vid-in designate display of an image which scrolls and moves from the left to the right of FIG. 22A by one pixel with the progress of a first frame, a second frame, and a third frame. In this case, when video signals Vid-out are output, there is a risk boundary at the same location during the entire one frame (that is, for 16.67 milliseconds) formed by first to fourth fields as shown in FIG. 22B. If there is the risk boundary at the same position for a long time, a poor alignment state of the liquid crystal molecules tends to be fixed as described above, and thus a reverse tilt domain is likely to occur in an adjacent pixel. Therefore, in a case where an applied voltage designated by the video signal Vid-in is lower than Vth1, when the applied voltage is corrected to a voltage equal to or higher than Vth1 and is applied to a liquid crystal element, a pixel of the liquid crystal element is not a dark pixel any longer, and thus a risk boundary is not present at the same position during the entire one frame period.

Figures 23A, 23B:
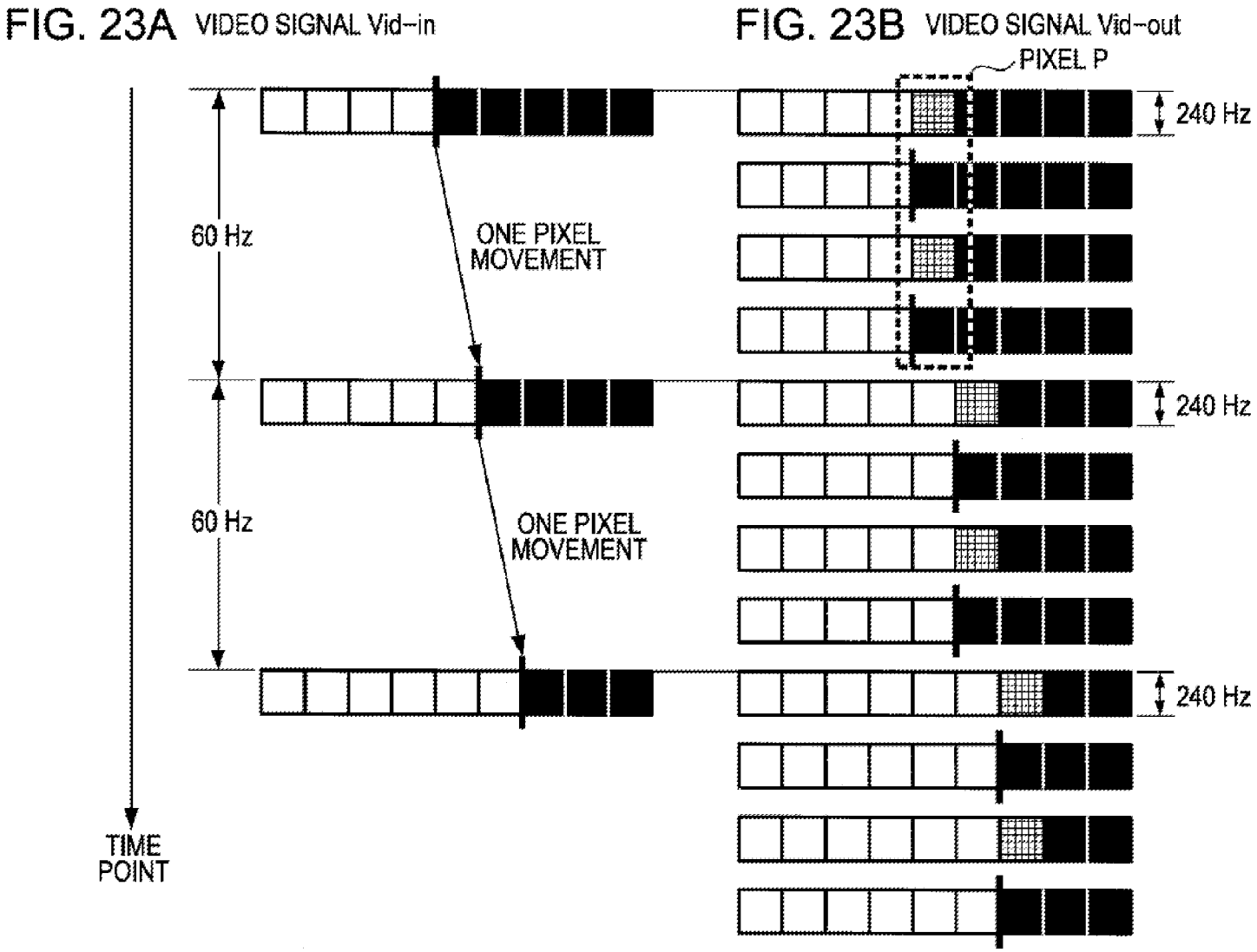
FIGS. 23A and 23B are diagrams illustrating an example of the correction process for interrupting temporal continuity of a risk boundary.

Here, a correction process as shown in FIGS. 23A and 23B is considered. In the correction process, in the first and third fields of one frame period, an applied voltage to a dark pixel (indicated by the lattice hatching in FIG. 23B) adjacent to a bright pixel is corrected to a voltage (here, 2.5 V which is intermediate between 0 V and 5.0 V) corresponding to an intermediate grayscale. In this way, a transverse electric field is not generated at a location which is a boundary between the dark pixel and the bright pixel in the first and third field, and thus temporal continuity of the transverse electric field can be interrupted. A time-series variation of a transmittance of the correction target pixel in this case is the same as an optical response waveform indicated by the solid line in FIG. 24A. The transmittance of the liquid crystal element during the entire one frame period corresponds to a transmittance (hereinafter, referred to as an "integral transmittance") obtained by temporally integrating a transmittance when a correction voltage corresponding to a grayscale level (correction grayscale) after being corrected and a grayscale (hereinafter, referred to as an "original grayscale") of an original image are alternately applied over one frame period. An integral transmittance in this case is as indicated by the broken line in FIG. 24A.

Figures 24A, 24B:
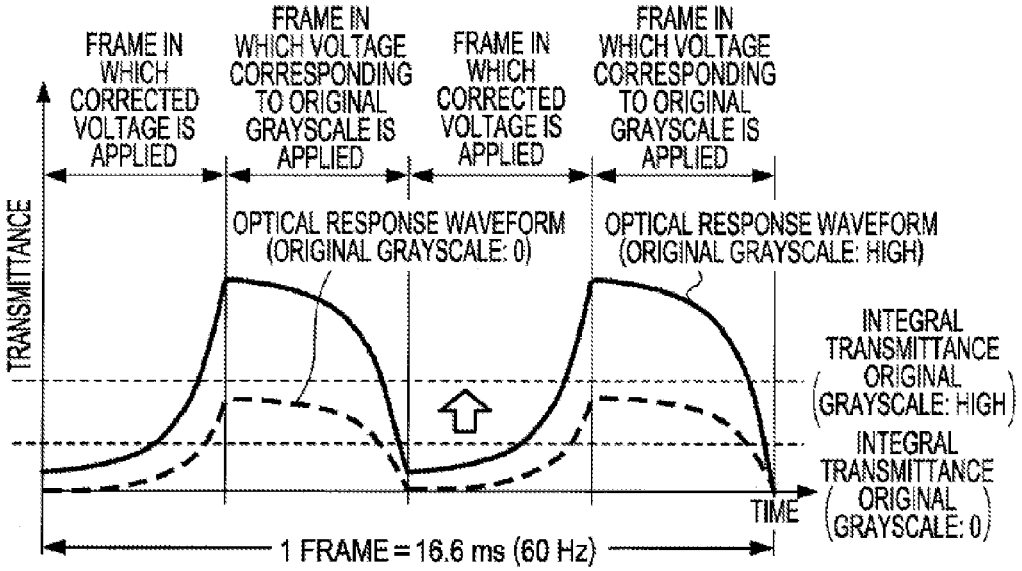
FIGS. 24A and 24B are diagrams illustrating an integral transmittance corresponding to an original grayscale and a correction grayscale.

FIG. 24B is a table illustrating an integral transmittance when a VA type liquid crystal panel is driven at 240 Hz, and a frame for applying a correction voltage (correction voltage application frame) and a frame for applying a voltage corresponding to an original grayscale are alternated. The numerical value in the table indicates an integral transmittance [%]. If an applied voltage corresponding to an original grayscale is 0 V, the integral transmittance varies from 0% to 0.64% due to application of a correction voltage (about 2.51 V corresponding to an intermediate grayscale) in the first and third fields, but the variation is relatively small (corresponding to a case of "original grayscale: 0" of FIG. 24A). On the other hand, if an applied voltage corresponding to an original grayscale is about 1.569 V, the integral transmittance greatly varies from 0.18% to 5.865% due to application of a correction voltage (2.51 V) (corresponding to a case of "original grayscale: high" of FIG. 24A). If the integral transmittance greatly varies as above, a variation in display content due to application of a correction voltage is likely to be perceived by a user. Therefore, in a case of performing the correction process as shown in FIGS. 23A and 23B, in the related art, a correction target pixel is restricted to a pixel to which an applied voltage designated by a video signal with an original grayscale is equal to or less than 1.26 V (a range indicated by "available range" in FIG. 24B), and a correction voltage is required to be reduced to about 2.2 V. However, in this correction process, since a correction target pixel is limited, and, further, a voltage range employed as a correction voltage is narrow, an effect of reducing a reverse tilt domain cannot be sufficiently achieved.

Therefore, in the present embodiment, some period of one frame period is used as a correction period, and a correction process is performed using a correction voltage higher than an applied voltage according to the applied voltage corresponding to an original grayscale. On the other hand, the applied voltage corresponding to the original grayscale is applied as it is (that is, no correction) in the other period thereof.

FIG. 7 is a table illustrating a relationship between an applied voltage corresponding to an original grayscale and a correction voltage corresponding to a correction voltage, employed in the present embodiment. The numerical value in the table indicates an integral transmittance [%]. In the present embodiment, as shown in FIG. 7, the higher the applied voltage corresponding to an original grayscale of a dark pixel, the lower the correction voltage corresponding to the dark pixel. If this correction process is performed, it is possible to suppress a variation in the integral transmittance in each frame period and to increase an effect of reducing a reverse tilt domain as compared with the case where correction is not performed using a correction voltage corresponding to an applied voltage designated by the video signal Vid-in as described with reference to FIGS. 24A and 24B. Specifically, in a case where an applied voltage to a dark pixel is 0 V, since the applied voltage to the dark pixel is low, it is considered that a strong transverse electric field tends to occur, and there is in an alignment state in which a reverse tilt domain is likely to occur. In contrast, as shown in FIG. 7, even if a correction voltage is increased to 2.5 V in the first and third fields, an integral transmittance in one frame period is 0.64%, and a variation in the integral transmittance is limited to 0.64%. In addition, in a case where an applied voltage to a dark pixel is 0.314 V to 1.255 V, when a correction voltage is 2.196 V in the first and third fields, the integral transmittance is limited to about 0.18% to 0.67%, and thus a variation from a case of no correction is small. Further, in a case where an applied voltage to a dark pixel is 1.596 V, when a correction voltage is 1.882 V in the first and third fields, the integral transmittance is limited to about 0.46%.

If the above-described correction process is performed, it is considered that the integral transmittance before and after the correction is equal to or less than 0.7%, and thus a variation in display content due to the correction is unlikely to be perceived by a user. In the present embodiment, a correction voltage is defined such that the integral transmittance is 0.7% (first threshold integral transmittance), but a correction voltage may be defined such that the integral transmittance is equal to or less than a value other than 0.7%. According to the relationship of the voltages surrounded by the range indicated by the thick solid line in the table of FIG. 7, a variation in display content can be made to be hard to be visible even if a correction voltage is increased in order to increase an effect of reducing a reverse tilt domain with respect to a dark pixel with a low potential in which a reverse tilt domain tends to occur, and a variation in display content can be made to be hard to be visible by reducing a correction voltage with respect to a dark pixel with a relatively high potential in which a reverse tilt domain is relatively unlikely to occur.

The video processing circuit 30 in FIG. 1 is a circuit for preventing an occurrence of the reverse tilt domain in the liquid crystal panel 100 in advance by processing a video signal Vid-in of a current frame based on this concept.

Figure 3:
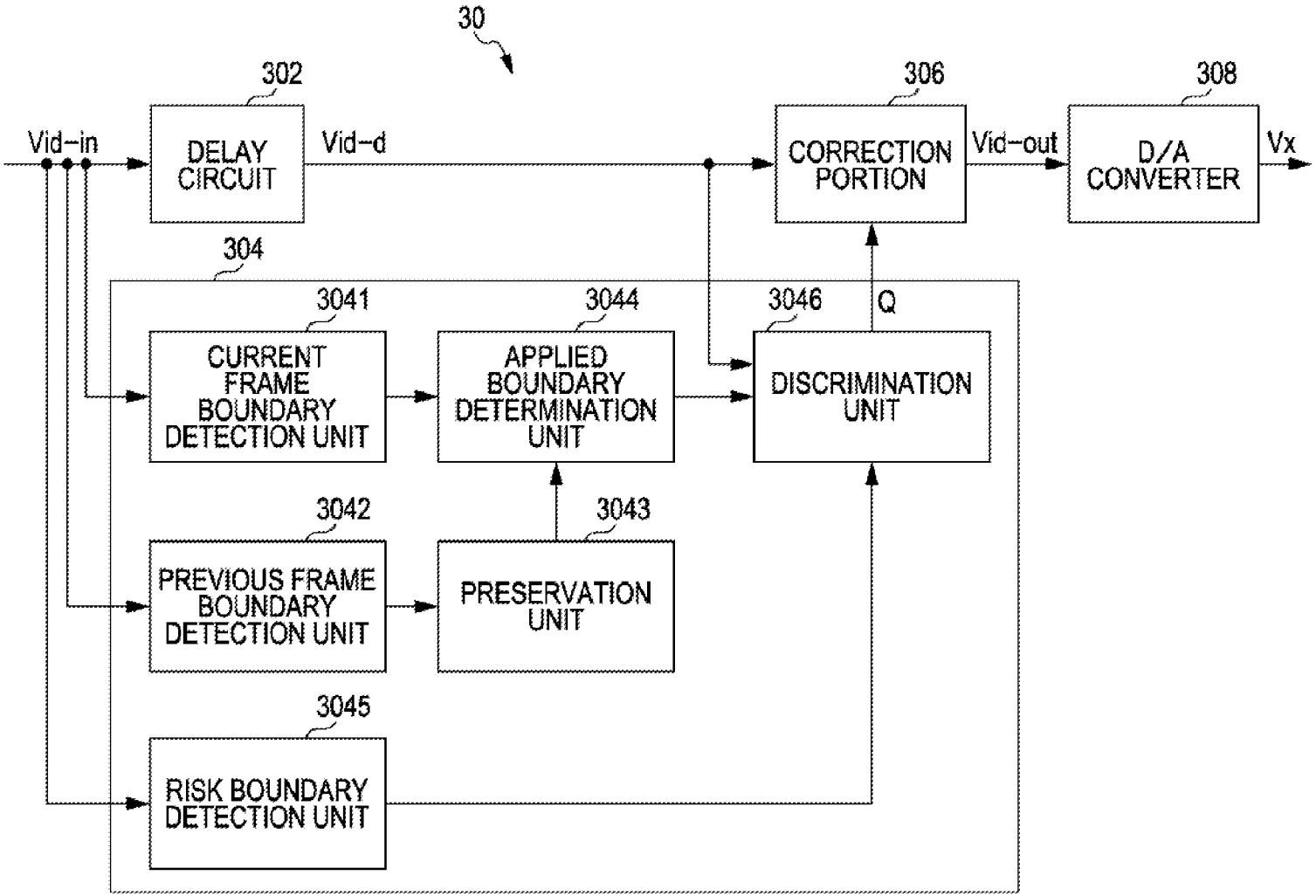
FIG. 3 is a diagram illustrating a configuration of the same video processing circuit.

Next, details of the video processing circuit 30 will be described with reference to FIG. 3. As shown in FIG. 3, the video processing circuit 30 includes a delay circuit 302, a boundary detection portion 304, a correction portion 306, and a D/A converter 308. FIGS. 8A to 9B are diagrams illustrating boundary detection procedures in the boundary detection portion 304.

The delay circuit 302 is constituted by a First In First Out (FIFO) memory, a multi-stage latch circuit, or the like, accumulates video signals Vid-in supplied from a high rank device, and reads the signals after a predetermined time has elapsed so as to be output as video signals Vid-d. In addition, the accumulation and reading in the delay circuit 302 are controlled by the scanning control circuit 20.

The boundary detection portion 304 includes a current frame boundary detection unit 3041, a previous frame boundary detection unit 3042, a preservation unit 3043, an applied boundary determination unit 3044, a risk boundary detection unit 3045, and a discrimination unit 3046.

Figure 8A:
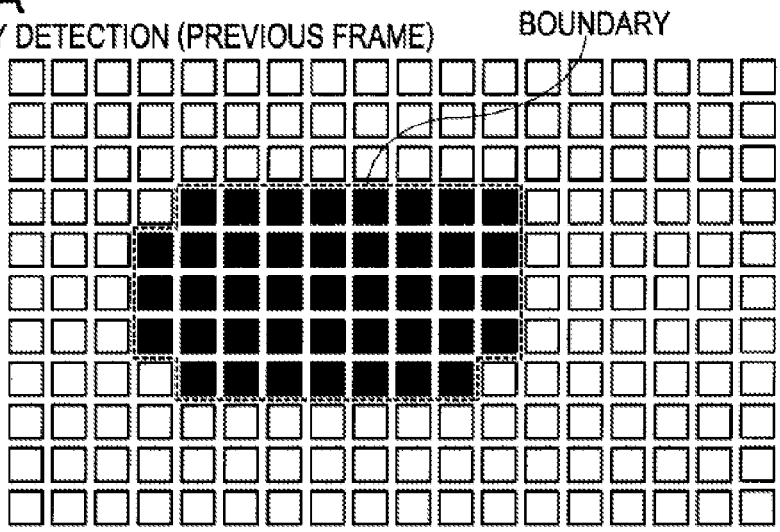
FIGS. 8A to 8C are diagrams illustrating boundary detection procedures in the same video processing circuit.
Figure 8B:
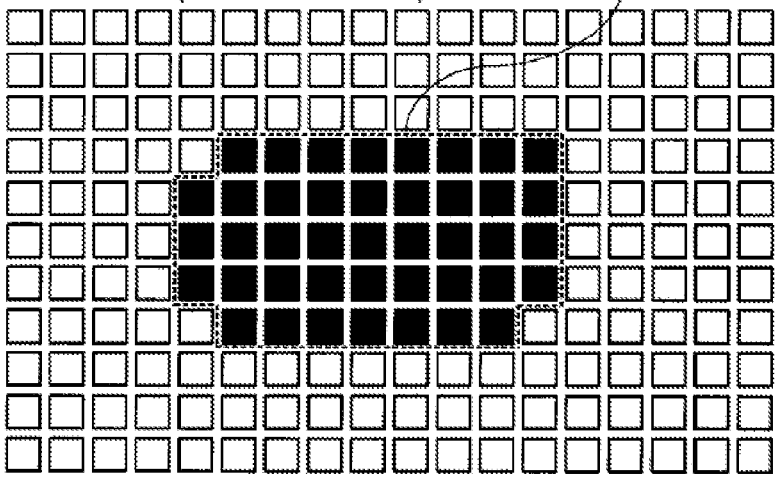
Figure 8C:
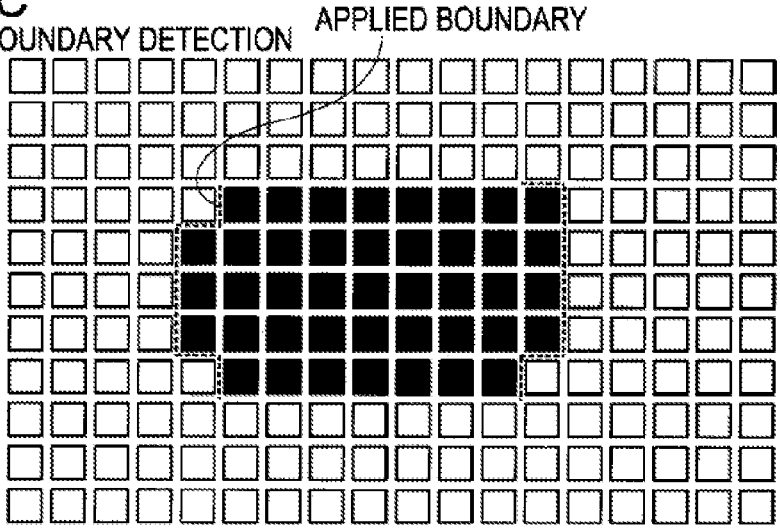

The current frame boundary detection unit 3041 analyzes an image represented by a video signal Vid-in of a current frame and discriminates whether or not there is a part where a dark pixel in the grayscale range a and a bright pixel in the grayscale range b are adjacent to each other. In addition, when it is discriminated that there is an adjacent part, the current frame boundary detection unit 3041 detects a boundary which is the adjacent part and outputs position information of the boundary. Here, the current frame boundary detection unit 3041 analyzes the image represented by the video signal Vid-in of the current frame and detects a boundary present in the position indicated by the dotted line as shown in FIG. 8B. Here, the image represented by the video signal Vid-in is an image in which bright pixels in the grayscale range b are used as a background and a pattern of dark pixels in the grayscale range a is disposed.

The previous frame boundary detection unit 3042 analyzes an image represented by a video signal Vid-in of a previous frame (that is, one frame before the current frame) and detects a part where a dark pixel and a bright pixel are adjacent as a boundary. The previous frame boundary detection unit 3042 performs a process of the same procedures as the current frame boundary detection unit 3041 on the basis of the video signal Vid-in, so as to detect a boundary, and outputs position information of the detected boundary.

The preservation unit 3043 preserves the position information of the boundary detected by the previous frame boundary detection unit 3042 so as to be delayed by one frame period and be output.

Therefore, the boundary detected by the current frame boundary detection unit 3041 is related to the current frame, whereas the boundary which is detected by the previous frame boundary detection unit 3042 and is preserved in the preservation unit 3043 is related to the previous frame. Here, it is assumed that the previous frame boundary detection unit 3042 analyzes an image represented by the video signal Vid-in of a previous frame and detects the boundary present at the position indicated by the dotted line as shown in FIG. 8A. As can be seen from FIGS. 8A and 8B, the image represented by the video signal Vid-in is an image in which the pattern of the dark pixels in the grayscale range a scrolls and moves to the right in the background of the bright pixels in the grayscale range b.

The applied boundary determination unit 3044 determines a boundary which is obtained by excluding the same boundary as the boundary of the previous frame preserved in the preservation unit 3043 among boundaries of the current frame detected by the current frame boundary detection unit 3041, as an applied boundary. In other words, the applied boundary is a boundary which varies from the previous frame to the current frame, that is, is not present in the previous frame and is present in the current frame. Therefore, the applied boundary determination unit 3044 determines the boundary at the position indicated by the dotted line in FIG. 8C as an applied boundary.

The risk boundary detection unit 3045 analyzes an image represented by a video signal Vid-in of a current frame and discriminates whether or not there is a part where a dark pixel in the grayscale range a and a bright pixel in the grayscale range b are adjacent to each other in the vertical direction or horizontal direction. In addition, the risk boundary detection unit 3045 detects a part where the dark pixel is located on the upper side and the bright pixel is located on the lower side and a part where the dark pixel is located on the right side and the bright pixel is located on the left side as risk boundaries, and outputs position information of the detected risk boundaries. Here, as shown in FIG. 9A, the risk boundary detection unit 3045 analyzes the image represented by the video signal Vid-in of the current frame and determines the boundary at the position indicated by the dotted line as a risk boundary.

The discrimination unit 3046 discriminates whether or not each pixel of the image represented by the video signal Vid-d of the current frame which is delayed and is output by the delay circuit 302 is a dark pixel adjacent to a boundary (hereinafter, referred to as a "correction target boundary") which is an applied voltage determined by the applied boundary determination unit 3044 and is a risk boundary detected by the risk boundary detection unit 3045. If the discrimination result is "Yes", the discrimination unit 3046 outputs a flag Q of an output signal as "1" with respect to this dark pixel. If the discrimination result is "No", the discrimination unit 3046 outputs a flag Q of an output signal as "0" with respect to this dark pixel. Here, the discrimination unit 3046 outputs the flag Q of the output signal as "1" with respect to the dark pixels (indicated by the lattice hatching) adjacent to the correction target boundary indicated by the broken line in FIG. 9B, and outputs the flag Q of the output signal as "0" with respect to the other pixels.

The above description relates to the configuration of the boundary detection portion 304.

Figures 11A, 11B:
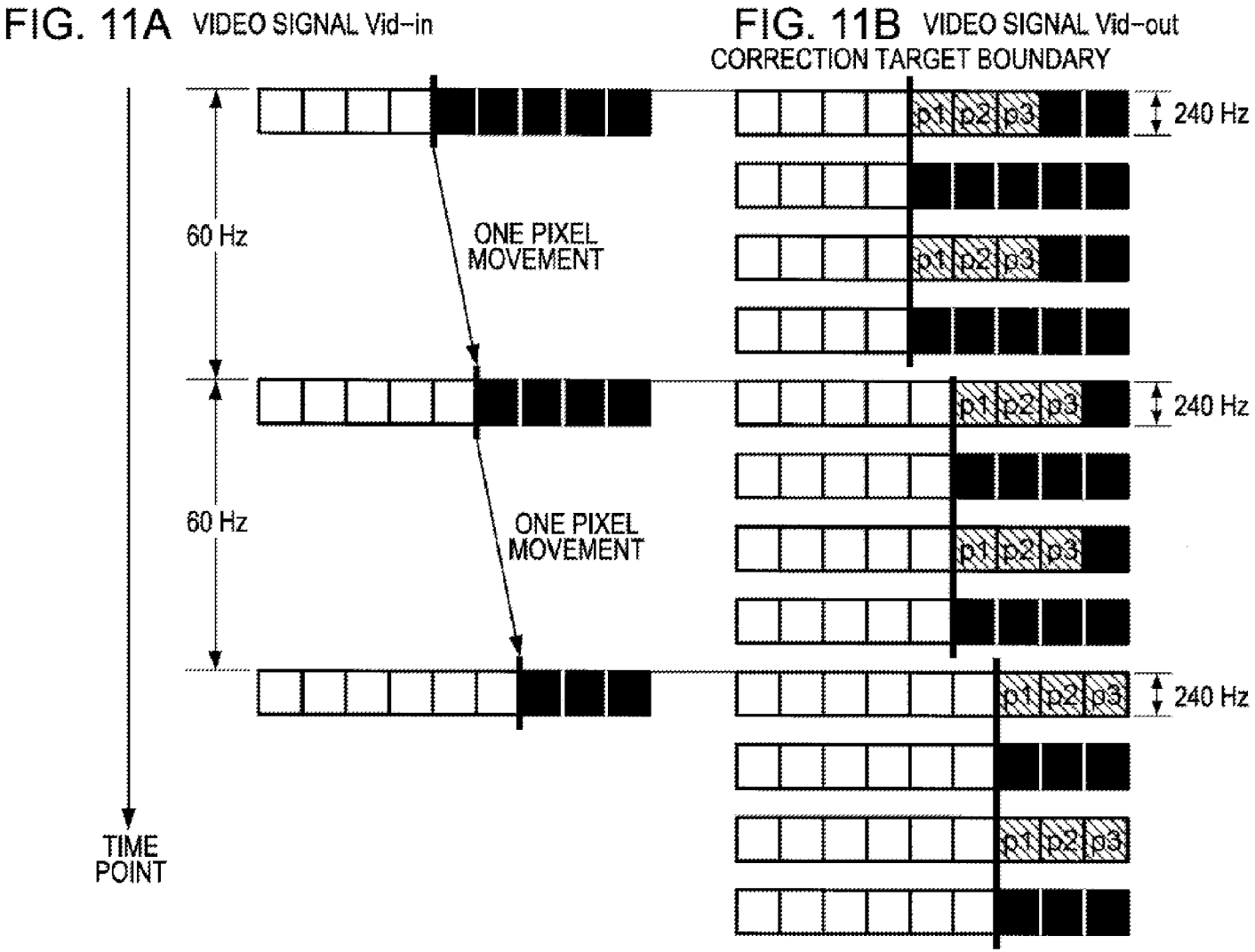
FIGS. 11A and 11B are diagrams illustrating a correction period in the same video processing circuit.

In a case where a grayscale level of the video signal Vid-d is equal to or lower than a predefined first grayscale level (for example, a grayscale level corresponding to an applied voltage 1.6 V), when the flag Q supplied from the discrimination unit 3046 is "1", the correction portion 306 corrects video signals Vid-d of M (where M is an integer equal to or more than 2; here, M=3) dark pixels which are continuously located in an opposite direction to the correction target boundary from the dark pixel adjacent to the correction target boundary in the first and third fields of one frame period, so as to be output as video signals Vid-out. On the other hand, in a case where a pixel is a dark pixel in which a grayscale level of the video signal Vid-d is higher than the first grayscale level, in a case of periods corresponding to the second and fourth fields when the flag Q supplied from the discrimination unit 3046 is "1", and in case where the flag Q supplied from the discrimination unit 3046 is "0", the correction portion 306 outputs the video signal Vid-d as a video signal Vid-out without correcting the video signal. Here, the correction portion 306 corrects video signals of the dark pixels indicated by the diagonal line on the lower right in FIG. 10. As shown in FIG. 11A, in a case where the video signals Vid-in designate display of an image which scrolls and moves from the left to the right of FIG. 11A by one pixel with the progress of a first frame, a second frame, and a third frame, the correction portion 306 corrects video signals of the correction target pixels in the first and third fields of each frame as shown in FIG. 11B. Here, as shown in FIG. 11B, a dark pixel adjacent to the correction target boundary is set to p1, and dark pixels p2 and p3 are assumed to be arranged in an opposite direction to the correction target boundary from the dark pixel p1.

Figure 12:
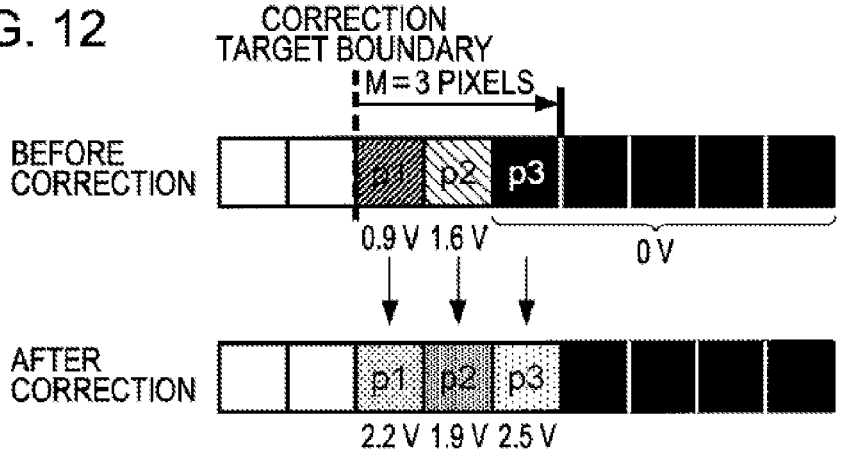
FIG. 12 is a diagram illustrating a correction voltage in the same video processing circuit.

Next, with reference to FIG. 12, a description will be made that the correction portion 306 performs correction to a video signal designating a correction voltage. As shown in FIG. 12, it is assumed that, before the correction, an applied voltage designated by a video signal of the dark pixel p1 is 0.9 V, an applied voltage designated by a video signal of the dark pixel p2 is 1.6 V, and an applied voltage designated by a video signal of the dark pixel p3 is 0 V. In this case, the correction portion 306 sets a correction voltage so as to correlate the applied voltage of each dark pixel with the "applied voltage corresponding to an original grayscale" of the table of FIG. 7. Therefore, the correction portion 306 corrects the video signal of the dark pixel p1 to a video signal designating a correction voltage 2.2 V, corrects the video signal of the dark pixel p2 to a video signal designating a correction voltage 1.9 V, and corrects the video signal of the dark pixel p3 to a video signal designating a correction voltage 2.5 V, in the first and third fields.

In addition, for example, the correction portion 306 may determine a grayscale level of a video signal after being corrected by referring to a lookup table which regulates a relationship between a grayscale level of a video signal before being corrected and a grayscale level of a video signal after being corrected.

The above description relates to the correction process by the correction portion 306.

The D/A converter 308 converts the video signal Vid-out which is digital data into an analog data signal Vx. In the present embodiment, since the surface inversion method is employed, a polarity of the data signal Vx is switched for one scene in the liquid crystal panel 100.

Next, a display operation of the liquid crystal display apparatus 1 will be described. The video signal Vid-in is supplied from the high rank device in order of the pixels of the first row and the first column to the first row and the n-th column, the second row and the first column to the second row and the n-th column, the third row and the first column to the third row and the n-th column, . . . , and the m-th row and the first column to the m-th row and the n-column, during one frame. The video processing circuit 30 performs processes such as delay and correction on the video signal Vid-in so as to be output as the video signal Vid-out.

Here, in a horizontal effective scanning period (Ha) when the video signals Vid-out of the first row and the first column to the first row and the n-th column are output, the processed video signals Vid-out are converted into positive or negative data signals Vx by the D/A converter 308 as shown in FIG. 5B. Here, for example, conversion into a positive data signal is performed in the first field. This data signals Vx are sampled in the first to n-th data lines 114 as data signals X1 to Xn by the data line driving circuit 140.

On the other hand, during the horizontal scanning period when the video signals Vid-out of the first row and the first column to the first row and the n-th column are output, the scanning control circuit 20 controls the scanning line driving circuit 130 such that only the scanning signal Y1 is in an H level. When the scanning signal Y1 is in an H level, the TFTs 116 of the first row are turned on, and thus the data signals sampled in the data lines 114 are applied to the pixel electrodes 118 via the turned-on TFTs 116. Thereby, positive voltages which respectively correspond to the video signals Vid-out are written in the liquid crystal elements of the first row and the first column to the first row and the n-th column.

Successively, video signals Vid-in of the second row and the first column to the second row and the n-th column are processed by the video processing circuit 30 in the same manner so as to be output as video signals Vid-out which are converted into positive data signals by the D/A converter 308 and are then sampled in the first to n-th data lines 114 by the data line driving circuit 140.

During the horizontal scanning period when the video signals Vid-out of the second row and the first column to the second row and the n-th column are output, since only the scanning signal Y2 is turned to an H level by the scanning line driving circuit 130, the data signals sampled in the data lines 114 are applied to the pixel electrodes 118 via the turned-on TFTs 116 of the second row. Thereby, positive voltages which respectively correspond to the video signals Vid-out are written in the liquid crystal elements of the second row and the first column to the second row and the n-th column.

Hereinafter, the same writing operation is performed on the third, fourth, . . . , and the m-th rows, and thereby voltages corresponding to grayscale levels designated by the video signals Vid-out are written in the respective liquid crystal elements such that a transmissive image regulated by the video signals Vid-in is created.

In the next field, the same writing operation is performed except that the video signal Vid-out is converted into a negative data signal according to polarity inversion of the data signal.

FIG. 5B is a voltage waveform diagram illustrating an example of the data signal Vx of the first and second fields when the video signals Vid-out of the first row and the first column to the first row and the n-th column are output from the video processing circuit 30 during the horizontal scanning period (H). Since the normally black mode is employed in the present embodiment, the data signal Vx becomes a high potential side voltage (indicated by the upward arrow in FIG. 5B) corresponding to a grayscale level processed by the video processing circuit 30 with respect to the reference voltage Vcnt in a positive polarity, and becomes a low potential side voltage (indicated by the downward arrow in FIG. 5B) corresponding to a grayscale level with respect to the reference voltage Vcnt in a negative polarity.

Specifically, a voltage of the data signal Vx becomes a voltage deviated from the reference voltage Vcnt a range from the voltage Vw(+) corresponding to white to the voltage Vb(+) corresponding to black in a positive polarity, and becomes a voltage deviated from the reference voltage Vcnt a range from the voltage Vw(−) corresponding to white to the voltage Vb(−) corresponding to black in a negative polarity.

The voltage Vw(+) and the voltage Vw(−) are symmetric to each other with respect to the voltage Vcnt. The voltage Vb(+) and the voltage Vb(−) are also symmetric to each other with respect to the voltage Vcnt.

In addition, FIG. 5B shows a voltage waveform of the data signal Vx which is different from a voltage (a potential difference between the pixel electrode 118 and the common electrode 108) applied to the liquid crystal element 120. Further, the longitudinal scale of the voltage of the data signal in FIG. 5B is enlarged as compared with the voltage waveform of the scanning signal and the like in FIG. 5A.

In the video processing circuit 30 of the above-described first embodiment uses some of one frame period as a correction period, and corrects a video signal of the dark pixel to a video signal which designates a correction voltage corresponding to an applied voltage designated by a video signal with an original grayscale. At this time, the video processing circuit 30 performs correction to a video signal which designates a higher correction voltage as an applied voltage is lowered. In a case where an original grayscale is low and thus an applied voltage is low, the video processing circuit 30 uses a correction voltage which considerably increases an applied voltage in order to increase an effect of reducing a reverse tilt domain, but an integral transmittance before and after correction is restricted to 0.7% or less, and thus a variation in display content due to the correction is hard to be perceived by a user. On the other hand, in a case where an original grayscale is high and thus an applied voltage is high, since a reverse tilt domain is relatively unlikely to occur, the reverse tilt domain is hard to occur even if a correction voltage is set to be low such that an integral transmittance before and after correction is restricted to 0.7% or less. Thereby, a risk boundary is not continuously present at the same position during one frame period. In addition, as compared with the correction process described in FIGS. 23A and 23B, a reverse tilt domain is hard to occur and a variation in the integral transmittance is suppressed, thereby correcting a video signal corresponding to each display period so as to suppress a transmittance variation of the liquid crystal element for each display period and to reduce a reverse tilt domain.

Modification Example 1 of First Embodiment

Figure 13:
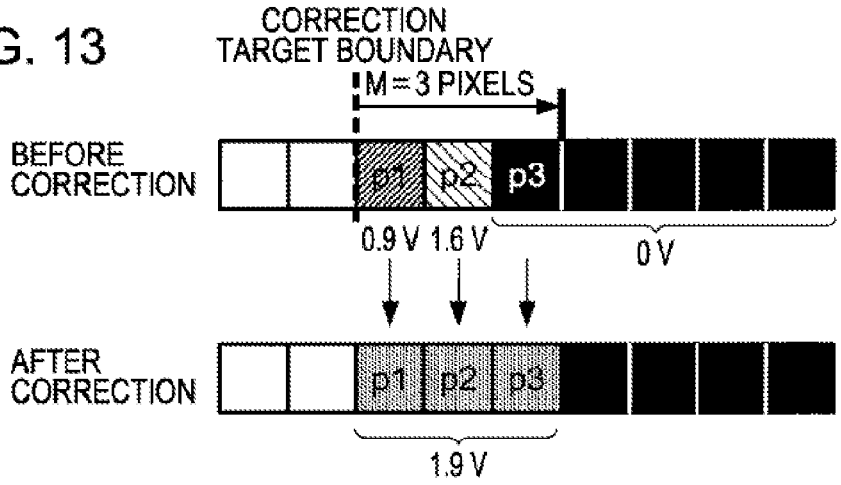
FIG. 13 is a diagram illustrating a correction voltage in a video processing circuit related to Modification Example 1 of the first embodiment.

Although, in the above-described first embodiment, the correction portion 306 individually sets a correction voltage of a dark pixel which is a correction target according to an applied voltage of the dark pixel, a correction voltage set based on several dark pixels of M dark pixels which are continuously located from a correction target boundary may be used in common to the M dark pixels. For example, the correction portion 306 sets a correction voltage corresponding to a dark pixel to which an applied voltage is the highest among the M dark pixels. As shown in FIG. 13, it is assumed that, before the correction, an applied voltage designated by a video signal of the dark pixel p1 is 0.9 V, an applied voltage designated by a video signal of the dark pixel p2 is 1.6 V, and an applied voltage designated by a video signal of the dark pixel p3 is 0 V. In this case, the correction portion 306 sets a correction voltage according to the dark pixel p2 to which the applied voltage is the highest, and sets 1.9 V here. In addition, the correction portion 306 corrects video signals of the dark pixels p1, p2 and p3 to video signals designating the correction voltage 1.9 V. To summarize, the correction portion 306 uses the lowest correction voltage among correction voltages corresponding to the M dark pixels in common. With this configuration, the correction portion 306 may specify a pixel of the lowest voltage from M dark pixels and set a correction voltage, and thus a necessary calculation process amount is reduced as compared with a case where a correction voltage is individually set for each dark pixel.

Modification Example 2 of First Embodiment

Although, in the above-described first embodiment, the video processing circuit 30 sets M (where M=3) dark pixels which are continuously located in an opposite direction to a correction target boundary from a dark pixel adjacent to the correction target boundary as correction target pixels, the number M of correction target pixels may be any number. Specifically, the video processing circuit 30 may correct a video signal of only a dark pixel adjacent to a correction target boundary at M=1, or may correct video signals of M dark pixels which are continuously located in an opposite direction to the correction target boundary from a dark pixel adjacent to the correction target boundary at M=2 or M=4 or more.

Modification Example 3 of First Embodiment

Although, in the above-described embodiment, a case where a tilt azimuth θb is 45 degrees in the VA type has been described as an example, the tilt azimuth θb may be other angles. Even in this case, the video processing circuit 30 may be operated in the same manner as in the first embodiment except that the risk boundary detection unit 3045 detects a different risk boundary depending on the tilt azimuth θb.

A dark pixel and a bright pixel are adjacent to each other at a tilt azimuth θb of 225 degrees, and, if the dark pixel is reversely located on the left side or the lower side of the bright pixel, the dark pixel may be set as a correction target pixel. A dark pixel and a bright pixel are adjacent to each other at a tilt azimuth θb of 90 degrees, and, if the dark pixel is reversely located on the right side or the upper side of the bright pixel, the dark pixel may be set as a correction target pixel.

Second Embodiment

Next, the second embodiment of the invention will be described.

In this embodiment, the video processing circuit 30 does not set a dark pixel as a correction target but sets a bright pixel as a correction target. In addition, the video processing circuit 30 uses some of one frame period as a correction period and sets a correction voltage corresponding to an applied voltage of a bright pixel in the same manner as in the above-described embodiment. Specifically, the video processing circuit 30 increases a correction voltage as an applied voltage of a bright pixel designated by an input video signal is lower.

In the following description, the same constituent elements as in the first embodiment are given the same reference numerals, and description thereof will be appropriately omitted.

Specifically, the video processing circuit 30 increases a correction voltage as an applied voltage of a bright pixel designated by a video signal Vid-in is lower. If this correction process is performed, it is possible to make a variation in display content hard to be visible and to increase an effect of reducing a reverse tilt domain as compared with a case where correction is not performed using a correction voltage corresponding to an applied voltage designated by the video signal Vid-in for the same reason as in the first embodiment. Specifically, it is considered that a correction process on a bright pixel is performed such that the integral transmittance before and after the correction is equal to or more than 95%, and thus a variation in display content due to the correction is unlikely to be perceived by a user. In the present embodiment, a correction voltage is defined such that the integral transmittance is 95% (second threshold integral transmittance) or more, but a correction voltage may be defined such that the integral transmittance is equal to or more than a value other than 95%. Thereby, a variation in display content can be made to be hard to be visible even if a correction voltage is decreased in order to increase an effect of reducing a reverse tilt domain with respect to a bright pixel with a high potential in which a reverse tilt domain tends to occur, and a variation in display content can be made to be hard to be visible by reducing a correction voltage with respect to a bright pixel with a low potential in which a reverse tilt domain is relatively unlikely to occur.

In addition, in the present embodiment as well, the correction portion 306 corrects a video signal in the first and third fields, and does not correct a video signal in the second and fourth fields.

In relation to a configuration of the video processing circuit 30 of the present embodiment, a difference from the first embodiment will be described.

The discrimination unit 3046 discriminates whether or not each pixel of the image represented by the video signal Vid-d of the current frame which is delayed and is output by the delay circuit 302 is a bright pixel adjacent to a correction target boundary. If the discrimination result is "Yes", the discrimination unit 3046 outputs a flag Q of an output signal as "1" with respect to this bright pixel. If the discrimination result is "No", the discrimination unit 3046 outputs a flag Q of an output signal as "0" with respect to this bright pixel.

Figure 14:
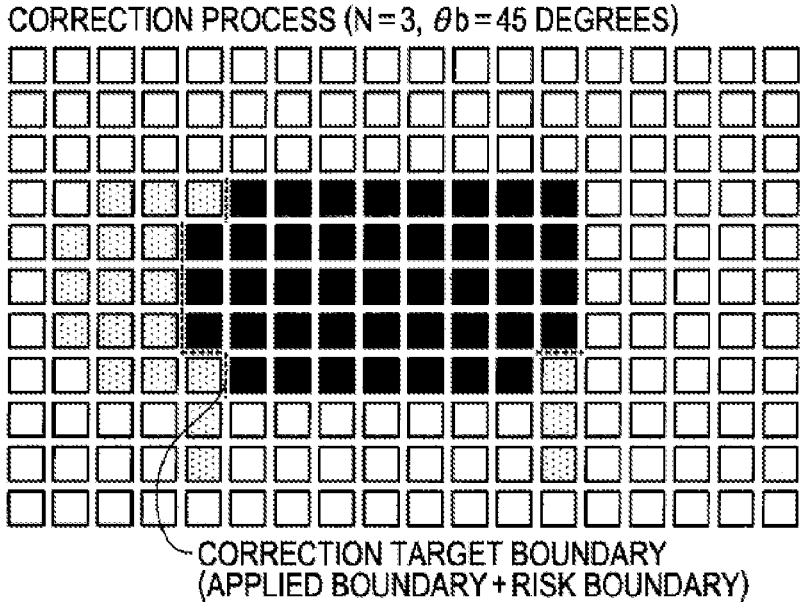
FIG. 14 is a diagram illustrating a correction target boundary and a correction target pixel in a video processing circuit according to a second embodiment.
Figures 15A, 15B:
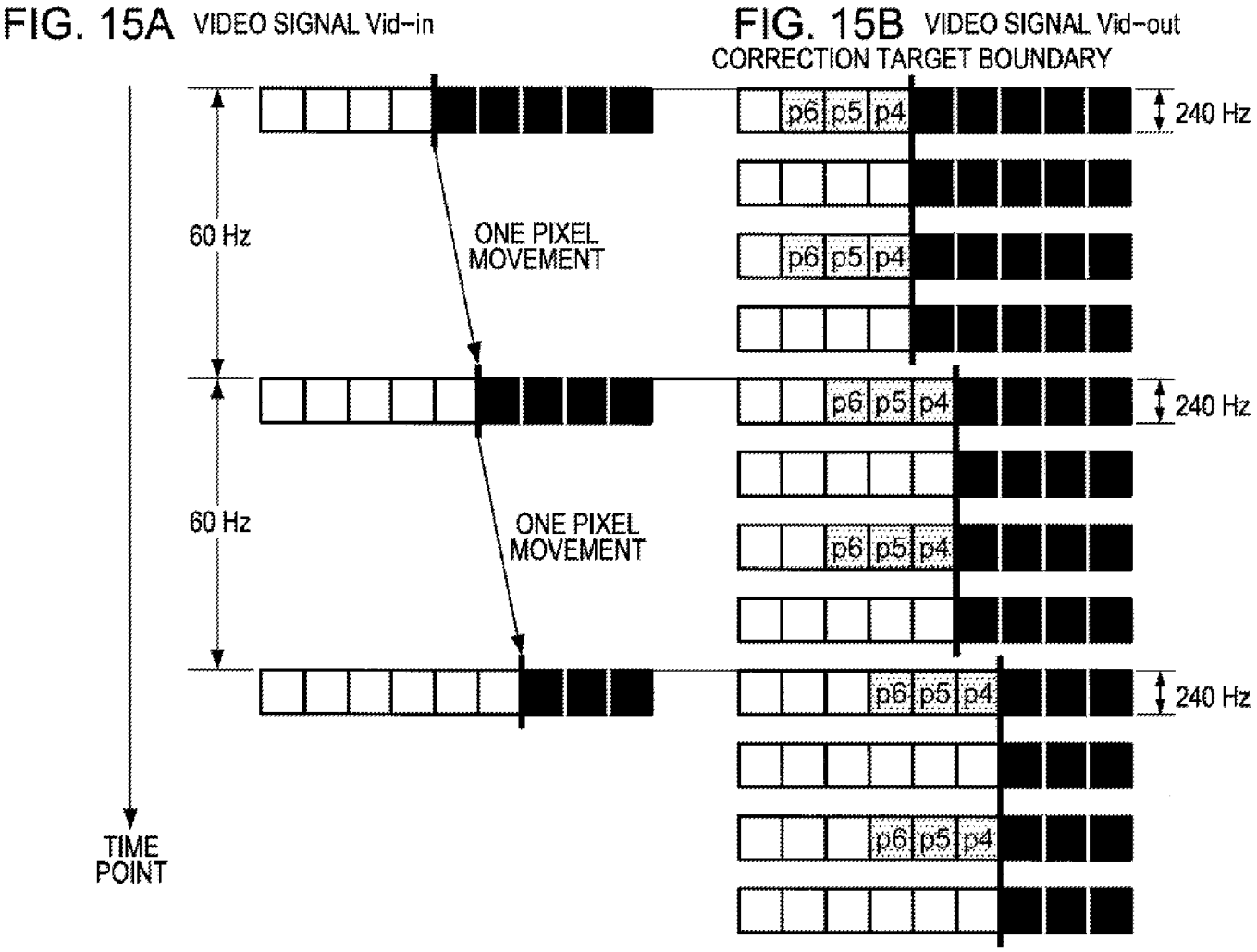
FIGS. 15A and 15B are diagrams illustrating a correction period in the same video processing circuit.

In a case where a grayscale level of the video signal Vid-d is equal to or higher than a predefined second grayscale level (for example, a grayscale level corresponding to an applied voltage 3.4 V), when the flag Q supplied from the discrimination unit 3046 is "1", the correction portion 306 corrects video signals Vid-d of N (where N is an integer equal to or more than 2; here, N=3) bright pixels which are continuously located in an opposite direction to the correction target boundary from the bright pixel adjacent to the correction target boundary in the first and third fields of one frame period, so as to be output as video signals Vid-out. On the other hand, in a case where a pixel is a bright pixel in which a grayscale level of the video signal Vid-d is lower than the second grayscale level, in a case of periods corresponding to the second and fourth fields when the flag Q supplied from the discrimination unit 3046 is "1", and in case where the flag Q supplied from the discrimination unit 3046 is "0", the correction portion 306 outputs the video signal Vid-d as a video signal Vid-out without correcting the video signal. Here, the correction portion 306 corrects video signals of the dark pixels indicated by the dots on the lower right in FIG. 14. As shown in FIG. 15A, in a case where the video signals Vid-in designate display of an image which scrolls and moves from the left to the right of FIG. 15A by one pixel with the progress of a first frame, a second frame, and a third frame, the correction portion 306 corrects video signals of the correction target pixels in the first and third fields of each frame as shown in FIG. 15B. Here, as shown in FIG. 15B, a bright pixel adjacent to the correction target boundary is set to p4, and bright pixels p5 and p6 are assumed to be arranged in an opposite direction to the correction target boundary from the bright pixel p4.

Figure 16:
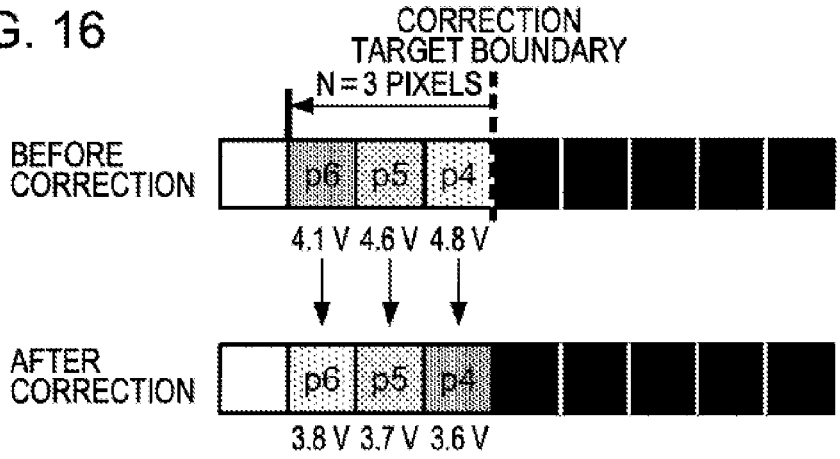
FIG. 16 is a diagram illustrating a correction voltage in the same video processing circuit.

Next, with reference to FIG. 16, a description will be made that the correction portion 306 performs correction to a video signal designating a correction voltage. As shown in FIG. 16, it is assumed that, before the correction, an applied voltage designated by a video signal of the bright pixel p4 is 4.8 V, an applied voltage designated by a video signal of the bright pixel p5 is 4.6 V, and an applied voltage designated by a video signal of the bright pixel p6 is 4.1 V. In this case, the correction portion 306 corrects the video signal of the bright pixel p4 to a video signal designating a correction voltage 3.6 V, corrects the video signal of the bright pixel p5 to a video signal designating a correction voltage 3.7 V, and corrects the video signal of the bright pixel p6 to a video signal designating a correction voltage 3.8 V, in the first and third fields.

In the video processing circuit 30 of the above-described second embodiment uses some of one frame period as a correction period, and corrects a video signal of the bright pixel to a video signal which designates a correction voltage corresponding to an applied voltage designated by a video signal with an original grayscale. At this time, the video processing circuit 30 performs correction to a video signal which designates a lower correction voltage as an applied voltage is higher. In a case where an original grayscale is high and thus an applied voltage is high, the video processing circuit 30 uses a correction voltage which considerably decreases an applied voltage in order to increase an effect of reducing a reverse tilt domain, but an integral transmittance before and after correction is restricted to 95% or more, and thus a variation in display content due to the correction is hard to be perceived by a user. On the other hand, in a case where an original grayscale is low and thus an applied voltage is low, since a reverse tilt domain is relatively unlikely to occur, the reverse tilt domain is hard to occur even if a correction voltage is set to be high such that an integral transmittance before and after correction is 95% or more. Thereby, in the video processing circuit 30 of the present embodiment, for the same reason as in the first embodiment, it is possible to correct a video signal corresponding to each display period so as to suppress a transmittance variation of the liquid crystal element for each display period and to reduce a reverse tilt domain.

Modification Example 1 of Second Embodiment

Figure 17:
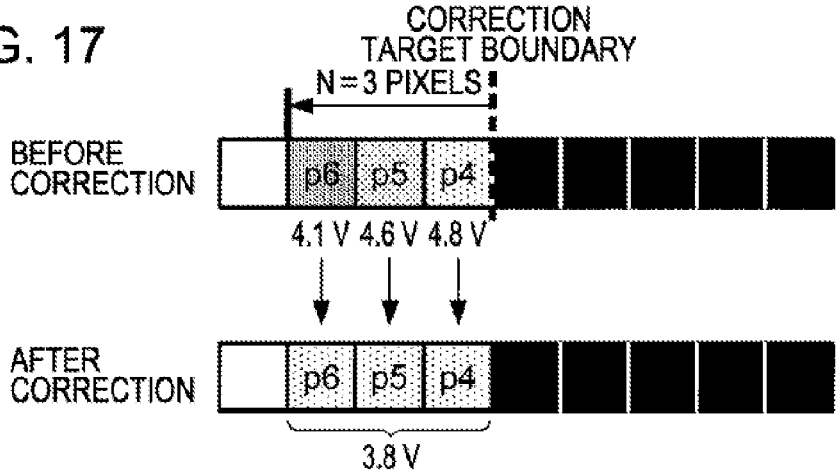
FIG. 17 is a diagram illustrating a correction voltage in a video processing circuit related to Modification Example 1 of the second embodiment.

Although, in the above-described second embodiment, the correction portion 306 individually sets a correction voltage of a bright pixel which is a correction target according to an applied voltage of the bright pixel, a correction voltage set based on several bright pixel of N bright pixels which are continuously located from a correction target boundary may be used in common to the N bright pixels. For example, the correction portion 306 sets a correction voltage corresponding to a bright pixel to which an applied voltage is the lowest among the N bright pixels. As shown in FIG. 17, it is assumed that, before the correction, an applied voltage designated by a video signal of the bright pixel p4 is 4.8 V, an applied voltage designated by a video signal of the bright pixel p5 is 4.6 V, and an applied voltage designated by a video signal of the bright pixel p6 is 4.1 V. In this case, the correction portion 306 sets a correction voltage according to the bright pixel p6 to which the applied voltage is the lowest, and sets 3.8 V here. In addition, the correction portion 306 corrects video signals of the bright pixels p4, p5 and p6 to video signals designating the correction voltage 3.8 V. To summarize, the correction portion 306 uses the highest correction voltage among correction voltages corresponding to the N bright pixels in common. With this configuration, the correction portion 306 may specify a pixel of the highest voltage from N bright pixels and set a correction voltage, and thus a necessary calculation process amount is reduce as compared with a case where a correction voltage is individually set for each bright pixel.

Modification Example 2 of Second Embodiment

Although, in the above-described second embodiment, the video processing circuit 30 sets N (where N=3) bright pixels which are continuously located in an opposite direction to a correction target boundary from a bright pixel adjacent to the correction target boundary as correction target pixels, the number N of correction target pixels may be any number. Specifically, the video processing circuit 30 may correct a video signal of only a bright pixel adjacent to a correction target boundary at N=1, or may correct video signals of N bright pixels which are continuously located in an opposite direction to the correction target boundary from a bright pixel adjacent to the correction target boundary at N=2 or N=4 or more.

Modification Example 3 of Second Embodiment

Although, in the second embodiment, a case where a tilt azimuth θb is 45 degrees in the VA type has been described as an example, the tilt azimuth θb may be other angles as described in "Modification Example 3 of First Embodiment".

Third Embodiment

Next, the third embodiment of the invention will be described.

In this embodiment, the video processing circuit 30 sets a dark pixel as a correction target as in the above-described first embodiment, and sets a bright pixel as a correction target as in the second embodiment. In other words, the video processing circuit 30 may have both of the configurations described in the first and second embodiments, and may perform both of the operations described in the respective embodiments.

In the following description, the same constituent elements as in the first and second embodiments are given the same reference numerals, and description thereof will be appropriately omitted. Successively, in relation to a configuration of the video processing circuit 30 of the present embodiment, a difference from the first and second embodiments will be described.

The discrimination unit 3046 discriminates whether or not each pixel of the image represented by the video signal Vid-d of the current frame which is delayed and is output by the delay circuit 302 is either a dark pixel or a bright pixel adjacent to a correction target boundary. If the discrimination result is "Yes", the discrimination unit 3046 outputs a flag Q of an output signal as "1" with respect to this bright pixel. If the discrimination result is "No", the discrimination unit 3046 outputs a flag Q of an output signal as "0" with respect to this bright pixel.

Figure 18:
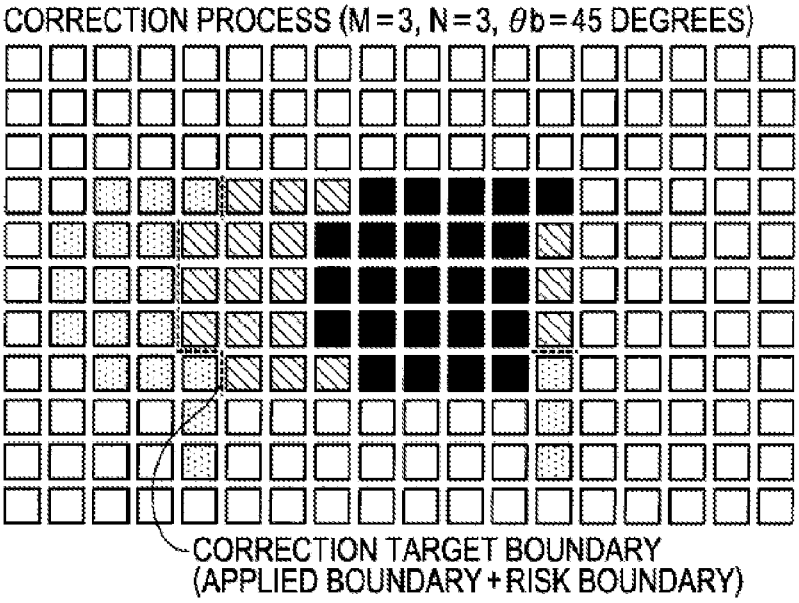
FIG. 18 is a diagram illustrating a correction target boundary and a correction target pixel in a video processing circuit according to a third embodiment.
Figures 19A, 19B:
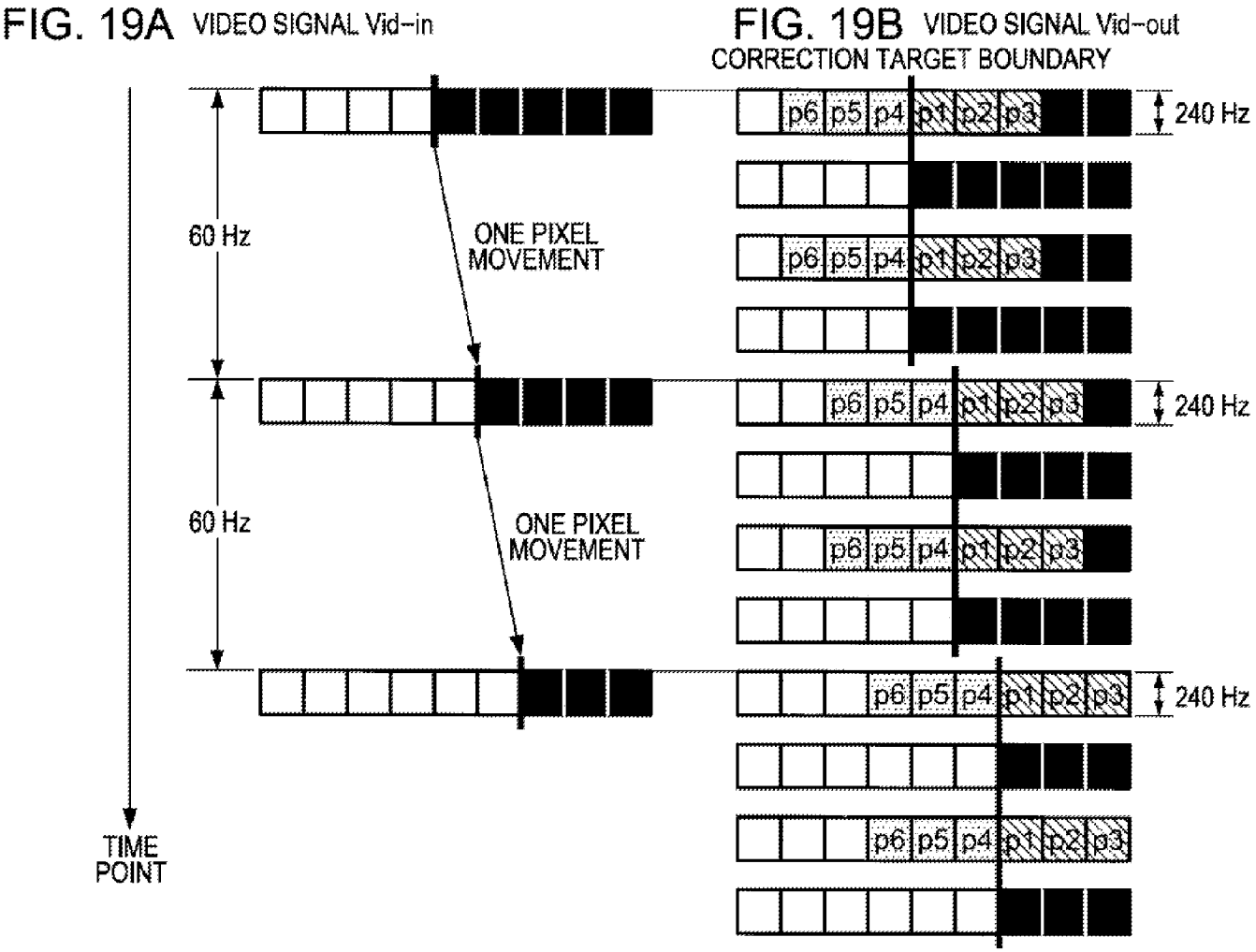
FIGS. 19A and 19B are diagrams illustrating a correction period in the same video processing circuit.

In a case where the flag Q supplied from the discrimination unit 3046 is "1", when the pixel adjacent to the correction target boundary is a dark pixel, the correction portion 306 corrects a video signal of the dark pixel according to the procedures described in the first embodiment, and, when the pixel adjacent to the correction target boundary is a bright pixel, the correction portion 306 corrects a video signal of the bright pixel according to the procedures described in the second embodiment. Here, the correction portion 306 corrects video signals of the dark pixels indicated by the diagonal line and video signals of the bright pixels indicated by the dots on the lower right in FIG. 18 in an image which is represented by the video signal Vid-d and varies as shown in FIGS. 8A and 8B. As shown in FIG. 19A, in a case where the video signals Vid-in designate display of an image which scrolls and moves from the left to the right of FIG. 19A by one pixel with the progress of a first frame, a second frame, and a third frame, the correction portion 306 corrects video signals of the correction target pixels in the first and third fields of each frame as shown in FIG. 19B. The meanings of the dark pixels p1 to p3 and the bright pixels p4 to p6 and the content of correction processes are the same as in the above-described first and second embodiments.

According to the video processing circuit 30 of the above-described third embodiment, it is possible to achieve an effect equivalent to the first and second embodiments and to correct each of a dark pixel and a bright pixel adjacent to each other so as to reduce the strength of a transverse electric field, and to thereby suppress a variation in a video signal due to the correction of the dark pixel and the bright pixel and to increase an effect of reducing a reverse tilt domain.

Modification Example of Third Embodiment

The configurations of Modification Examples 1 to 3 of the first embodiment and Modification Examples 1 to 3 of the second embodiment described above may be applied to the video processing circuit 30 of the third embodiment.

Modification Examples

The invention may be implemented by forms different from the above-described embodiments. Hereinafter, modification examples which can be employed in common in the above-described first to third embodiments will be mainly described. In addition, the modification examples described below may be appropriately combined with each other.

Modification Example 1

In the respective embodiments, the video processing circuit 30 may detect boundaries to which a dark pixel and a bright pixel are adjacent in a current frame, and may set a pixel adjacent to a risk boundary which moves by one pixel (in the longitudinal direction or the transverse direction) from the previous frame to the current frame among the detected boundaries, as a correction target. As described above, when a region of the black pixels where white pixels are a background moves by two or more pixels for each frame, this tailing phenomenon is hard to become apparent. Therefore, among boundaries which vary from the previous frame to the current frame, the applied boundary determination unit 3044 of the video processing circuit 30 determines a boundary which moves by one pixel from the previous frame to the current frame as an applied boundary and does not determine the other boundaries as applied boundaries. With the configuration of Modification Example 1, the correction portion 306 can focus on a pixel in which display defects due to a reverse tilt domain is likely to be visible and correct a video signal on the basis of a correction target boundary corresponding to an applied boundary which is a boundary which moves by one pixel from a previous frame to a current frame. Thereby, it is possible to achieve an effect of reducing a reverse tilt domain and to further suppress occurrence of a variation in display content due to correction of a video signal.

Modification Example 2

In the respective embodiments, the video processing circuit 30 may set a correction voltage corresponding to temperature of the liquid crystal element 120. For example, the liquid crystal display apparatus 1 may be provided with a temperature sensor which detects temperature of the liquid crystal panel 100. In addition, the correction portion 306 sets a correction voltage corresponding to temperature detected by the temperature sensor.

The liquid crystal molecules have characteristics in which viscosity varies depending on temperature, and a transmittance of the liquid crystal element is unlikely to vary since the viscosity increases as temperature decreases even if the same voltage is applied to the liquid crystal element. Therefore, the correction portion 306 may increase a correction voltage as temperature detected by the temperature sensor becomes lower in a case where a video signal of a dark pixel is corrected. In addition, the correction portion 306 may decrease a correction voltage as temperature detected by the temperature sensor becomes lower in a case where a video signal of a bright pixel is corrected. For example, the correction portion 306 reflects a parameter corresponding to temperature on a correction voltage of a location in which the correction voltage is set from an original grayscale, thereby setting a final correction voltage. A specific technique related to a method of setting a final correction voltage is not particularly limited; however, for example, the correction portion 306 may increase a correction voltage by a predetermined ratio (for example, 10%) such that the lower the temperature, the higher the applied voltage, with respect to a dark pixel. In addition, a table which regulates a correspondence relationship between temperature and an increase amount may be stored in advance, and the correction portion 306 may set a final correction voltage by referring to the table. This configuration may also be employed in a case where the correction portion 306 reduces a correction voltage as temperature becomes lower with respect to a bright pixel.

In addition, the correction portion 306 may acquire information indicating temperature of the liquid crystal element 120 and may set a correction voltage according to temperature indicated by the acquired information, or may acquire information indicating temperature from a temperature sensor provided at a location other than the above-described location.

Modification Example 3

Although, in the above-described respective embodiments, the video processing circuit 30 uses the first and third fields as a correction period and the second and fourth fields as a non-correction period among four fields forming one frame, for example, the second and fourth fields may be used as a correction period, and the first and third fields may be used as a non-correction period. In addition, the video processing circuit 30 may use any number of fields for correcting a video signal, and, even in this case, the video processing circuit 30 may alternate a correction period and a non-correction period and correct a video signal.

Further, the video processing circuit 30 may correct a video signal in all fields of one frame period, but corrects a video signal to a video signal which designates a correction voltage corresponding to an applied voltage to the liquid crystal element 120 in at least some period. A correction voltage may be different in the other period.

In addition, in a case where the video processing circuit 30 corrects a dark pixel and a bright pixel as in the above-described third embodiment, correction periods of the dark pixel and the bright pixel may be different such that the dark pixel is corrected in the first and third fields, and the bright pixel is corrected in the second and fourth fields.

Modification Example 4

In the respective embodiments, the video processing circuit 30 sets a boundary which is an applied boundary and is also a risk boundary as a correction target boundary. Alternatively, the video processing circuit 30 may exclude either an applied boundary or a risk boundary from a correction target boundary. In other words, the video processing circuit 30 may set an applied boundary as a correction target boundary or may set a risk boundary as a correction target boundary. In addition, the video processing circuit 30 may exclude both of an applied boundary and a risk boundary from a correction target boundary. In other words, the video processing circuit 30 may set all boundaries between adjacent dark pixels and bright pixels as correction target boundaries. In the invention, some or all of boundaries between adjacent dark pixels and bright pixels may be set as correction target boundaries. Whether a boundary satisfying what condition is set as a correction target boundary may be determined in advance, for example, according to a balance between the number of correction pixels and an effect of reducing a reverse tilt domain.

In addition, in a case where the video processing circuit 30 is not required to detect an applied boundary or a risk boundary, the video processing circuit 30 may not have a configuration required to detect a boundary.

Modification Example 5

Although, in the respective embodiments, a dark pixel is a pixel in which an applied voltage to the liquid crystal element 120 is in the voltage range A and a bright pixel is a pixel in which an applied voltage to the liquid crystal element 120 is in the voltage range B, a dark pixel and a bright pixel may be determined according to other conditions. For example, a pixel in which an applied voltage (first voltage) to the liquid crystal element 120 is equal to or more than a predefined threshold voltage (third threshold voltage) may be set as a dark pixel (first pixel), and a pixel in which an applied voltage (second voltage) to the liquid crystal element 120 is equal to or more than a threshold voltage (fourth threshold voltage) higher than the threshold voltage may be set as a bright pixel (second pixel). A dark pixel and a bright pixel are two adjacent pixels, and is configured by a combination of a pixel designating a certain applied voltage to the liquid crystal element 120 and a pixel designating an applied voltage to the liquid crystal element 120, higher than the applied voltage, and other conditions may be changed.

Modification Example 6

Although, in the respective embodiments, the meaning of "being adjacent to a boundary" refers to a case where one side of a pixel is adjacent to a boundary, a case where a boundary which is continuous longitudinally and transversely is located at one corner of a pixel may be also included. In this way, although the number of correction pixels increases as compared with the respective embodiments, it is considered that an effect of reducing a reverse tilt domain increases, for example, in a case where an image moves obliquely.

Modification Example 7

In a case of correcting a video signal of a dark pixel, the correction portion 306 may correct the video signal of the dark pixel to a video signal with a grayscale level corresponding to the brightness of an image of the display region 101. For example, the correction portion 306 acquires information indicating the brightness of the display region 101, and performs correction such that the higher (that is, the brighter) the level of the brightness defined by the acquired information, the higher the grayscale level of a video signal after being corrected. This is because, since a variation in a grayscale due to the correction is unlikely to be visible as the display region 101 is brighter, display contradiction is unlikely to be perceived by a user even if a grayscale level after being corrected increases in order to prioritize reduction in a reverse tilt domain. There is the brightness (for example, illuminance) of peripheral video display surroundings of the display region 101 as the information indicating the brightness of the display region 101. In this case, the correction portion 306 may acquire a detection result from an optical sensor provided in the liquid crystal display apparatus 1, and the correction portion 306 may determine a corrected grayscale level. In addition, the correction portion 306 may acquire a grayscale level of an input video signal as the information (for example, an average value of grayscale levels of input video signals of one frame) indicating the brightness. This is because, as an image of video signals with higher grayscale levels is displayed, the display region 101 also becomes brighter. Further, the correction portion 306 may acquire mode information for designating any one of a plurality of video display modes which regulate the brightness or contrast ratio of an image displayed in the display region 101. The correction portion 306 uses a correction angle corresponding to the luminance or contrast ratio defined by a video display mode. In this case, the correction portion 306 may perform correction to a video signal with a grayscale level corresponding to a display mode in a state of increasing a grayscale level in order of a so-called dynamic mode, a normal mode and a power saving mode.

In addition, in relation to a method of determining a video signal after being corrected (an applied voltage to the liquid crystal element 120), the correction portion 306 may have a configuration in which a lookup table is referred to or calculation is performed using an arithmetic expression.

Modification Example 8

Although an example in which the liquid crystal 105 employs the VA type has been described in the respective embodiments, a TN type may be employed.

Modification Example 9

In a case where the liquid crystal display apparatus 1 according to the respective embodiments can display an image of a plurality of color components such as red (R), green (G) and blue (B) components, a correction voltage may be different for each color component. For example, since a variation in a video signal of the G component due to correction is unlikely to be perceived by a user as compared with the R and B components, the video processing circuit 30 may increase a variation in an applied voltage due to correction.

Modification Example 10

In addition, the video processing circuit of the invention is not limited to quadruple speed driving, and is applicable to a liquid crystal display apparatus employing speed driving such as, for example, double speed driving or eight times speed driving. Further, the video processing circuit of the invention is applicable to a liquid crystal display apparatus which does not employ the speed driving. For example, the video processing circuit may perform the above-described correction process by using at least some of display periods (for example, a plurality of frame periods) corresponding to video signals Vid-in of one scene as a correction period (for example, one frame period).

Modification Example 11

Although the video signal Vid-in designates a grayscale level of a pixel in the respective embodiments, the video signal Vid-in may directly designate an applied voltage to the liquid crystal element. In a case where the video signal Vid-in designates an applied voltage to the liquid crystal element, a boundary may be discriminated using a designated applied voltage, and a voltage may be corrected.

In addition, in the respective embodiments, the liquid crystal element 120 is not limited to a transmissive type and may be of a reflective type.

Electronic Equipment

Figure 20:
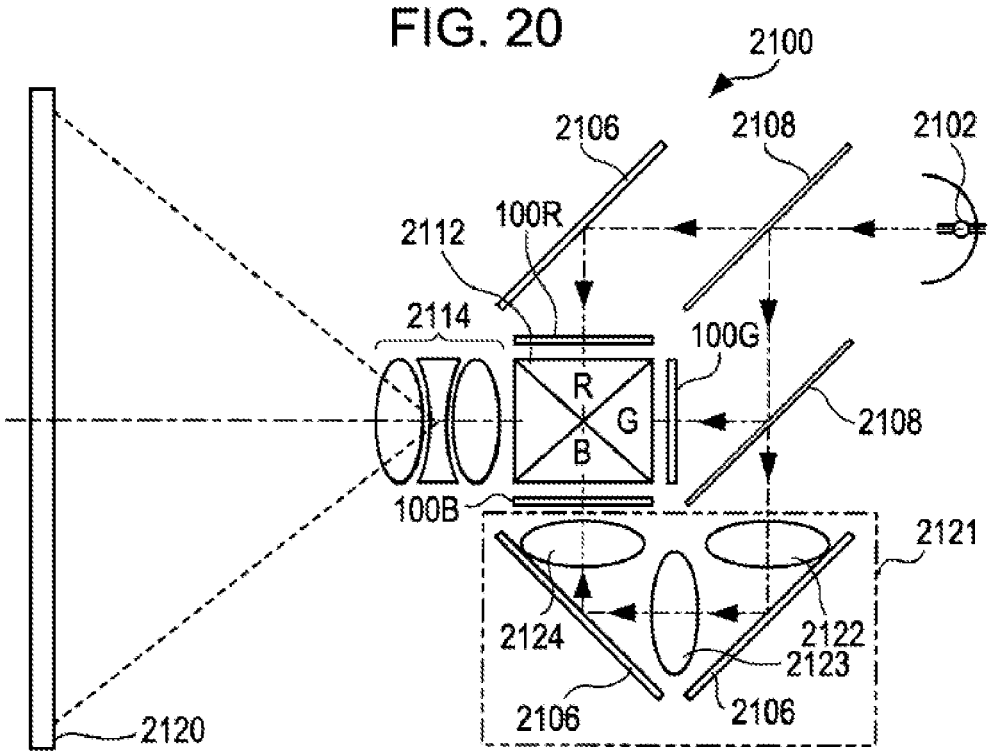
FIG. 20 is a diagram illustrating a projector which employs the liquid crystal display apparatus.

As an example of electronic equipment employing the liquid crystal display apparatus related to the above-described embodiments, projection type display equipment (projector) which uses the liquid crystal panel 100 as a light valve will be described. FIG. 20 is a plan view illustrating a configuration of the projector.

As shown in FIG. 20, a lamp unit 2102 including a white light source such as a halogen lamp or the like is provided in the projector 2100. Projection light emitted from the lamp unit 2102 is divided into three primary colors of red (R), green (G), and blue (B), by three mirrors 2106 and two dichroic mirrors 2108 disposed therein, and is guided to light valves 100R, 100G and 100B corresponding to the respective primary colors. The light of B has a longer light path than that of the R or the G, and is thus guided to a relay lens system 2121 including a light-incident lens 2122, a relay lens 2123, and a light-exciting lens 2124 in order to prevent losses thereof.

In this projector 2100, three liquid crystal display apparatuses which includes liquid crystal panel 100 are provided so as to respectively correspond to R, G, and B. Each of the light valves 100R, 100G and 100B has the same configuration as the above-described liquid crystal panel 100. A video signal corresponding to each primary color of R, G and B is supplied from an external high rank device, and the light valves 100R, 100G and 100B are respectively driven.

Light beams respectively modulated by the light valves 100R, 100G and 100B are incident to a dichroic prism 2112 from three directions. In this dichroic prism 2112, the light beams of R and B are refracted by 90 degrees, whereas the light of G travels straight. Thereby, images of the respective primary colors are combined, and then a color image is projected on a screen 2120 by a projection lens 2114.

Since the light beams respectively corresponding to R, G and B are incident to the light valves 100R, 100G and 100B by the dichroic mirror 2108, color filters are not required. In addition, the transmitted images from the light valves 100R and 100B are projected after reflected by the dichroic prism 2112, whereas the transmitted image from the light valve 100G is projected as it is, and thus the horizontal scanning direction by the light valves 100R and 100B is made to be reverse to the horizontal scanning direction by the light valve 100G, so as to display bilaterally inverted images.

As the electronic equipment, in addition to the projector described referring to FIG. 20, there are, for example, a television set, a view finder type/monitor direct view type video tape recorder, car navigation equipment, a pager, an electronic diary, an electronic calculator, a word processor, a workstation, a television-phone, a POS terminal, a digital still camera, a mobile phone, and equipment having a touch panel, and the like. Needless to say, the above-described liquid crystal display apparatus is applicable to the variety of electronic equipment.

This application claims priority to Japan Patent Application No. 2012-071904 filed Mar. 27, 2012, the entire disclosures of which are hereby incorporated by reference in their entireties.

What is claimed is:

1. A signal processing device which is used in a liquid crystal apparatus including a plurality of pixels, comprising:

a detection portion that detects a boundary between a first pixel corresponding to a first signal for applying a first voltage lower than a first reference voltage and a second pixel corresponding to a second signal for applying a second voltage higher than a second reference voltage on the basis of a signal for controlling a voltage applied to each of the plurality of pixels;

a correction portion that corrects a signal corresponding to M (where M is an integer greater than 1) pixels including the first pixel to a third signal for applying M third voltages that are each higher than the first voltage and lower than the second voltage, the M pixels being consecutively arranged on the same side of the boundary as the first pixel, each of the M third voltages being different from each other, and each of the M third voltages being applied to a separate one of the M pixels; and an output portion that outputs the signals, wherein the output portion outputs the third signal as the signal corresponding to the M pixels including the first pixel in a first period of a frame period;

outputs the first signal as the signal corresponding to the M pixels including the first pixel in a second period of the frame period; and outputs the third signal as the signal corresponding to the M pixels including the first pixel in a third period of the frame period; and wherein the M third voltages are each selected so that an integral transmittance obtained by temporally integrating a transmittance of the M pixels over the frame period does not exceed a threshold value.

2. The signal processing device according to claim 1, wherein the correction portion corrects the signal corresponding to the M pixels including the first pixels to the third signal for applying the M third voltages that are each higher than the first voltage and lower than the second voltage when the first voltage is lower than a third reference voltage which is lower than the first reference voltage.

3. The signal processing device according to claim 1, wherein the correction portion corrects a signal corresponding to N (where N is an integer equal to or more than 1) pixels including the second pixel to a fourth signal for applying a fourth voltage which is higher than the first voltage and lower than the second voltage, and wherein the output portion outputs the fourth signal as the signal corresponding to the N pixels including the second pixel in the first period;

outputs the second signal as the signal corresponding to the N pixels including the second pixel in the second period; and outputs the fourth signal as the signal corresponding to the N pixels including the second pixel in the third period.

4. The signal processing device according to claim 1, wherein the correction portion acquires information indicating temperature of a liquid crystal element, and makes the M third voltages different depending on temperature indicated by the acquired information.

5. A liquid crystal apparatus comprising the signal processing device according to claim 1.

6. Electronic equipment comprising the liquid crystal apparatus according to claim 5.

7. A signal processing device which is used in a liquid crystal apparatus including a plurality of pixels, comprising:

a detection portion that detects a first signal, corresponding to a first pixel, for applying a first voltage lower than a first reference voltage, and a second signal, corresponding to a second pixel adjacent to the first pixel, for applying a second voltage higher than a second reference voltage on the basis of a signal for controlling a voltage applied to each of the plurality of pixels;

a correction portion that corrects a signal corresponding to M (where M is an integer greater than 1) pixels including the first pixel to a third signal for applying M third voltages that are each higher than the first voltage and lower than the second voltage, the M pixels being consecutively arranged on the same side of the second pixel as the first pixel, each of the M third voltages being different from each other, and each of the M third voltages being applied to a separate one of the M pixels; and an output portion that outputs the signals, wherein the output portion outputs the third signal as the signal corresponding to the M pixels including the first pixel in a first period of a frame period;

outputs the first signal as the signal corresponding to the M pixels including the first pixel in a second period of the frame period; and outputs the third signal as the signal corresponding to the M pixels including the first pixel in a third period of the frame period; and wherein the M third voltages are each selected so that an integral transmittance obtained by temporally integrating a transmittance of the M pixels over the frame period does not exceed a threshold value.

8. A liquid crystal apparatus comprising the signal processing device according to claim 7.

9. Electronic equipment comprising the liquid crystal apparatus according to claim 8.

10. A signal processing method of processing signals displayed in a liquid crystal apparatus including a plurality of pixels, comprising:

detecting a boundary between a first pixel corresponding to a first signal for applying a first voltage lower than a first reference voltage and a second pixel corresponding to a second signal for applying a second voltage higher than a second reference voltage on the basis of a signal for controlling a voltage applied to each of the plurality of pixels;

correcting a signal corresponding to M (where M is an integer greater than 1) pixels including the first pixel to a third signal for applying M third voltages that are each higher than the first voltage and lower than the second voltage, the M pixels being consecutively arranged on the same side of the boundary as the first pixel, each of the M third voltages being different from each other, and each of the M third voltages being applied to a separate one of the M pixels; and outputting the signals, wherein the outputting of the signals includes outputting the third signal as the signal corresponding to the M pixels including the first pixel in a first period of a frame period;

outputting the first signal as the signal corresponding to the M pixels including the first pixel in a second period of the frame period; and outputting the third signal as the signal corresponding to the M pixels including the first pixel in a third period of the frame period; and wherein the M third voltages are each selected so that an integral transmittance obtained by temporally integrating a transmittance of the M pixels over the frame period does not exceed a threshold value.

* * * * *